US008695579B2

(12) United States Patent
Huebl

(10) Patent No.: US 8,695,579 B2
(45) **Date of Patent: *Apr. 15, 2014**

(54) TOY LAUNCHER FOR LAUNCHING PROJECTILES AND METHODS THEREOF

(71) Applicant: Easebon Services Limited, Kwun Tong (HK)

(72) Inventor: Steven J. Huebl, Jordan, MN (US)

(73) Assignee: Easebon Services Limited, Kwun Tong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 13/740,808

(22) Filed: Jan. 14, 2013

(65) Prior Publication Data

US 2013/0125870 A1 May 23, 2013

Related U.S. Application Data

(63) Continuation of application No. 12/854,739, filed on Aug. 11, 2010, now Pat. No. 8,353,277.

(51) Int. Cl.
*F41A 9/26* (2006.01)
*F41B 4/00* (2006.01)

(52) U.S. Cl.
USPC ..... 124/78

(58) Field of Classification Search
USPC ..... 124/56, 65, 72, 78, 59, 6, 58, 39; 42/54, 42/58; 446/473
See application file for complete search history.

(56) References Cited

U.S. PATENT DOCUMENTS

| | | | | |
|---|---|---|---|---|
| 3,304,928 | A | 2/1967 | Darrell | |
| 5,283,970 | A | 2/1994 | Aigner | |
| 5,722,384 | A | 3/1998 | Cox | |
| 5,724,955 | A | 3/1998 | Johnson | |
| 6,067,975 | A | 5/2000 | Ginn | |
| 7,677,232 | B2 | 3/2010 | Rosenblum et al. | |
| 8,353,277 | B2 * | 1/2013 | Huebl | 124/78 |
| 2002/0166551 | A1 | 11/2002 | Lee | |

* cited by examiner

*Primary Examiner* — Michael Carone
*Assistant Examiner* — Reginald Tillman, Jr.
(74) *Attorney, Agent, or Firm* — Amster, Rothstein & Ebenstein, LLP

(57) ABSTRACT

A toy launcher that can house a substantially large amount (e.g., 40, 60, 100, 200, etc.) of projectiles along the length of a rotatable projectile feed assembly. During use, a user can cause rotatable projectile feed assembly to rotate about it own axis and can cause projectiles to advance from the rotatable projectile feed assembly to a projectile launch assembly. At the projectile launch assembly, projectiles interact with at least one accelerator launching the projectile out of the toy launcher. The accelerator can be at least one rotating body.

10 Claims, 29 Drawing Sheets

TOY LAUNCHER FOR LAUNCHING PROJECTILES AND METHODS THEREOF

FIELD

The present invention relates to a toy launcher capable of substantially safely launching a substantially large number of projectiles without reloading.

BACKGROUND

Many children and young adults enjoy playing with toy guns. Some toy guns are designed to launch a projectile at a target (i.e., an inanimate object). One example of such a toy gun is a BB gun. BB guns shoot out BBs that are, typically speaking, small spheroid substantially hard metal objects capable of traveling at a substantially high rate of speed. Due to their size, shape, and speed of travel it is generally recommended that BB guns not be fired at another as this can cause substantial injury. Although BB guns are typically only fired at a target, one of the benefits of BB guns is that they can store a substantially large quantity of BBs thereby increasing the number of BBs that can be shot between reloading. To house this large quantity of BBs, BB guns typically include a surplus of BBs stored somewhat arbitrarily in a reservoir.

Other toy guns are designed to substantially safely launch a projectile at an individual. In this scenario the shape, physical constraints, and/or speed of travel of the projectile can be of concern. That is, unlike a BB gun, for this type of toy it is desirable that an individual hit by the projectile not be substantially injured. These shape, physical constraints, and/or speed of travel of the projectile can require a user to reload this type of toy gun after launching a single projectile and/or after launching a substantially small number of projectiles. Thus, although safe enough to be used against another individual during play, these toy guns are typically limited to a small quantity of projectiles and therefore require a user to repeatedly reload.

SUMMARY

In exemplary embodiments, a toy launcher for launching projectiles can comprise a rotatable projectile feed assembly that can include a plurality of receiving bodies having an opening extending a predetermined length from a proximal end to a distal end of the projectile feed assembly. These plurality of openings can be designed to receive a plurality of projectiles that may be housed sequentially along the length of the projectile feed assembly. The toy launcher can also comprise a projectile launching assembly that can include at least one accelerator that may be located substantially near the distal end of at least one of the receiving bodies. Further, the toy launcher can also comprise a user interface assembly that can include at least one user interface capable of being activated by a user, for example, causing the projectile feed assembly to rotate and at least one of the projectiles housed in at least one of the receiving bodies to advance toward the distal end of the receiving body and interact with the accelerator such that at least one projectile can be launched from the toy launcher.

In exemplary embodiments, the projectile can be a three dimensional object that can have a substantial length, substantial width, and/or substantial depth such that the three dimensional object can frictionally interact with a rotating body. These dimensions can also be selected to substantially reduce the risk of injury to an individual struck by the projectile.

In exemplary embodiments, the projectile can be a dart, a spheroid object, an ovoid object, a polygonal object, and/or an object with a suction cup or magnetic object.

In exemplary embodiments, the predetermined length of the receiving bodies can be determined based on the length of the projectile and the desired number of projectiles received in the receiving body. Also, in exemplary embodiments, the number of receiving bodies can be determined based on the length of the projectile and the number of projectiles desired to have received in the projectile feed assembly.

In exemplary embodiments, the plurality of receiving bodies can be a plurality of tubes. Further, the projectile feed assembly can be constructed from a plurality of projectile feed assemblies combined together and/or the projectile feed assembly can further comprise about 2 to about 100 receiving bodies.

In exemplary embodiments, the plurality of receiving bodies can be arranged in a substantially circular pattern. Further, the circular pattern can have an exterior surface and an interior surface and a projectile interfacing region can be located on the exterior surface and/or interior surface. In exemplary embodiments, the plurality of receiving bodies can be arranged in a substantially linear pattern in the receiving bodies. Further, in exemplary embodiments, the plurality of receiving bodies can be arranged such that more than one projectile can be launched, for example, at substantially the same time and/or in rapid succession.

In exemplary embodiments, the user interface can be a handle and/or trigger.

In exemplary embodiments, the receiving body can further comprise at least one projectile interfacing region that can be a slot extending at least some length of the receiving body. The user interface assembly can further comprise a slide rack capable of translating in a direction substantially parallel to at least one receiving body and at least one engagement mechanism can be coupled to the slide rack. Further, when the slide rack translates, at least one engagement mechanism can engage at least one projectile via the at least one projectile interfacing region and can advance at least one projectile toward the distal end of the receiving body such that at least one projectile interfaces with the accelerator causing it to be propelled from the toy launcher.

In exemplary embodiments, the plurality of receiving bodies can rotate when the user interfaces translates the slide rack. The plurality of receiving bodies can rotate about 30 degrees.

In exemplary embodiments, at least one of the engagement mechanism can at least partially extend through the slot to engage at least one projectile and at least one projectile can at least partially extend through the slot to engage the engagement mechanism.

In exemplary embodiments, the accelerator can further comprise at least one rotating body. Also, in exemplary embodiments, the accelerator can comprise a first flywheel that may be spaced a distance from a second flywheel and the spaced can be about just slightly less than the cross-sectional length of the projectile. Interacting with the first and second flywheel, at least one projectile can be accelerated out of the toy.

In exemplary embodiments, the accelerator can comprise a first flywheel spaced a distance from a surface and the spaced can be about just slightly less than the cross-sectional width of the projectile. Interacting with the first flywheel and the surface, the projectile can be accelerated out of the toy.

In exemplary embodiments, the accelerator can comprise a tread/track driven about a flywheel. In exemplary embodiments, the accelerator can be a flywheel powered by a motor and/or can be located substantially near the distal most end of the toy launcher such that the projectile speed may not be substantially reduced by frictional interaction with remaining elements of the toy launcher.

In exemplary embodiments, a toy launcher for launching projectiles can comprise a projectile feed assembly that can include at least one receiving body that can have an opening extending a predetermined length from a proximal end to a distal end of the projectile feed assembly, the opening can be designed to receive a plurality of projectiles housed sequentially along the length of the projectile feed assembly. The toy launcher can further comprise a projectile launching assembly that can include at least one accelerator and the launcher can further comprise a user interface assembly that can include at least one user interface capable of being activated by a user causing at least some element of the projectile feed assembly and/or projectile launching assembly to rotate and/or translate and causing at least one of the projectiles housed in at least one receiving body to advance toward the distal end of the receiving body and interact with the accelerator such that at least one projectile is launched from the toy launcher.

In exemplary embodiments, the projectile feed assembly can rotate and/or translate relative to the projectile launching assembly. Also, the projectile launching assembly can rotate and/or translate relative to the projectile feed assembly.

In exemplary embodiments, the projectile feed assembly can comprise a single receiving body.

In exemplary embodiments, the projectile can be a three dimensional object that can have a substantial length, substantial width, and/or substantial depth such that the three dimensional object can frictionally interact with a rotating body. These dimensions can also be selected to substantially reduce the risk of injury to an individual struck by the projectile.

In exemplary embodiments, the projectile can be a dart, a spheroid object, an ovoid object, a polygonal object, and/or an object with a suction cup or magnetic object.

In exemplary embodiments, the predetermined length of the receiving bodies can be determined based on the length of the projectile and the desired number of projectiles received in the receiving body. Also, in exemplary embodiments, the number of receiving bodies can be determined based on the length of the projectile and the number of projectiles desired to have received in the projectile feed assembly.

In exemplary embodiments, the at least one receiving body can be at least one tube. Further, the projectile feed assembly can be constructed from a plurality of projectile feed assemblies combined together and/or the projectile feed assembly can further comprise about 2 to about 100 receiving bodies.

In exemplary embodiments, a plurality of receiving bodies can be arranged in a substantially circular pattern. Further, the circular pattern can have an exterior surface and an interior surface and a projectile interfacing region can be located on the exterior surface and/or interior surface. In exemplary embodiments, a plurality of receiving bodies can be arranged in a substantially linear pattern in the receiving bodies. Further, in exemplary embodiments, the plurality of receiving bodies can be arranged such that more than one projectile can be launched, for example, at substantially the same time and/or in rapid succession.

In exemplary embodiments, the user interface can be a handle and/or trigger.

In exemplary embodiments, the receiving body can further comprise at least one projectile interfacing region that can be a slot extending at least some length of the receiving body. The user interface assembly can further comprise a slide rack capable of translating in a direction substantially parallel to at least one receiving body and at least one engagement mechanism can be coupled to the slide rack. Further, when the slide rack translates, at least one engagement mechanism can engage at least one projectile via the at least one projectile interfacing region and can advance at least one projectile toward the distal end of the receiving body such that at least one projectile interfaces with the accelerator causing it to be propelled from the toy launcher.

In exemplary embodiments, at least one receiving body can rotate when the user interfaces translates the slide rack. The at least one receiving body can rotate about 30 degrees.

In exemplary embodiments, at least one of the engagement mechanism can at least partially extend through the slot to engage at least one projectile and at least one projectile can at least partially extend through the slot to engage the engagement mechanism.

In exemplary embodiments, the accelerator can further comprise at least one rotating body. Also, in exemplary embodiments, the accelerator can comprise a first flywheel that may be spaced a distance from a second flywheel and the spaced can be about just slightly less than the cross-sectional length of the projectile. Interacting with the first and second flywheel, at least one projectile can be accelerated out of the toy.

In exemplary embodiments, the accelerator can comprise a first flywheel spaced a distance from a surface and the spaced can be about just slightly less than the cross-sectional width of the projectile. Interacting with the first flywheel and the surface, the projectile can be accelerated out of the toy.

In exemplary embodiments, the accelerator can comprise a tread/track driven about a flywheel. In exemplary embodiments, the accelerator can be a flywheel powered by a motor and/or can be located substantially near the distal most end of the toy launcher such that the projectile speed may not be substantially reduced by frictional interaction with remaining elements of the toy launcher.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying drawings and figures wherein.

DETAILED DESCRIPTION OF THE EXEMPLARY EMBODIMENTS

Figure 1A:
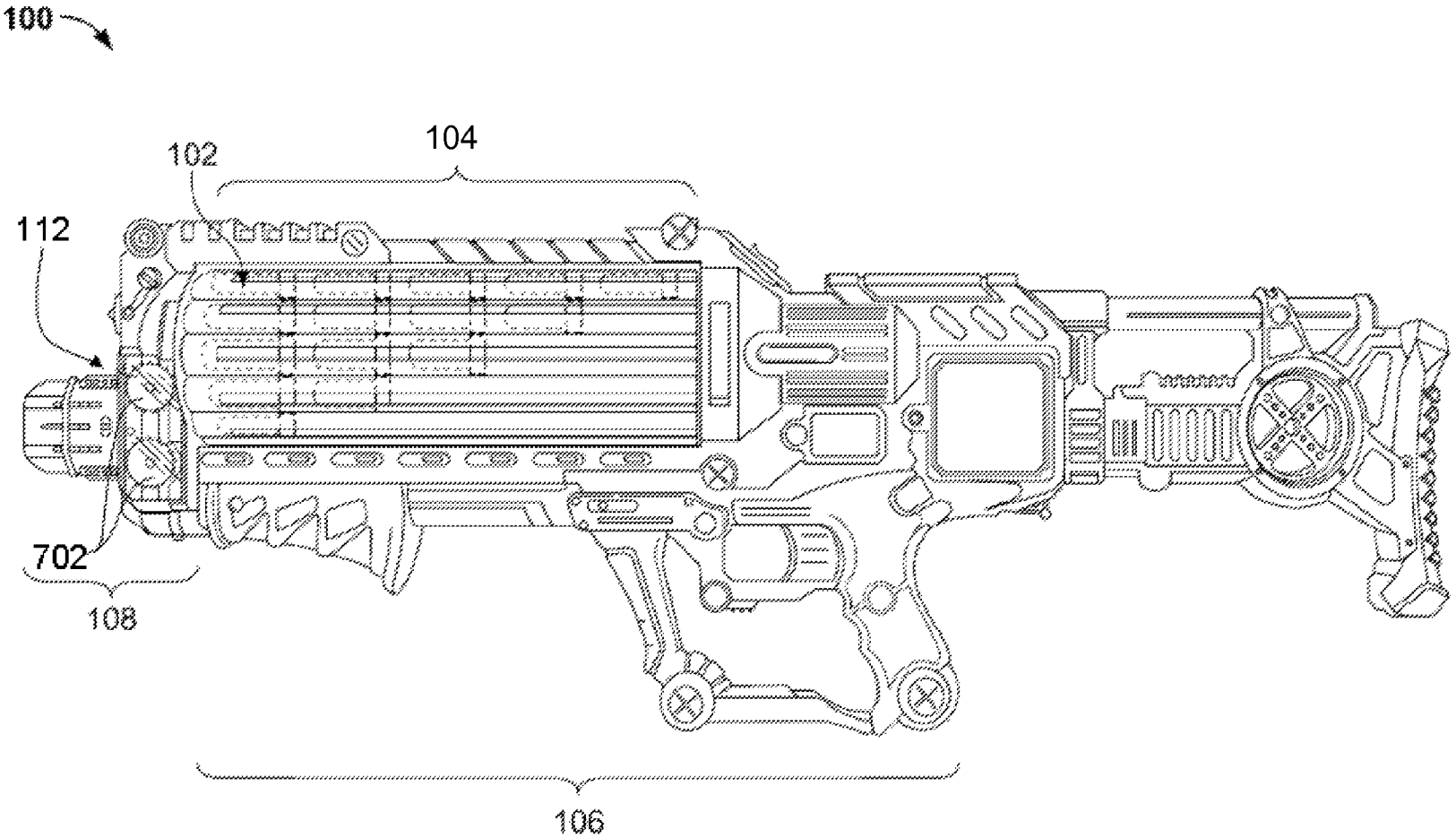
FIGS. 1A-1B illustratively depict a toy launcher for launching projectiles in an open and closed configuration, in accordance with exemplary embodiments of the present invention.
Figure 1B:
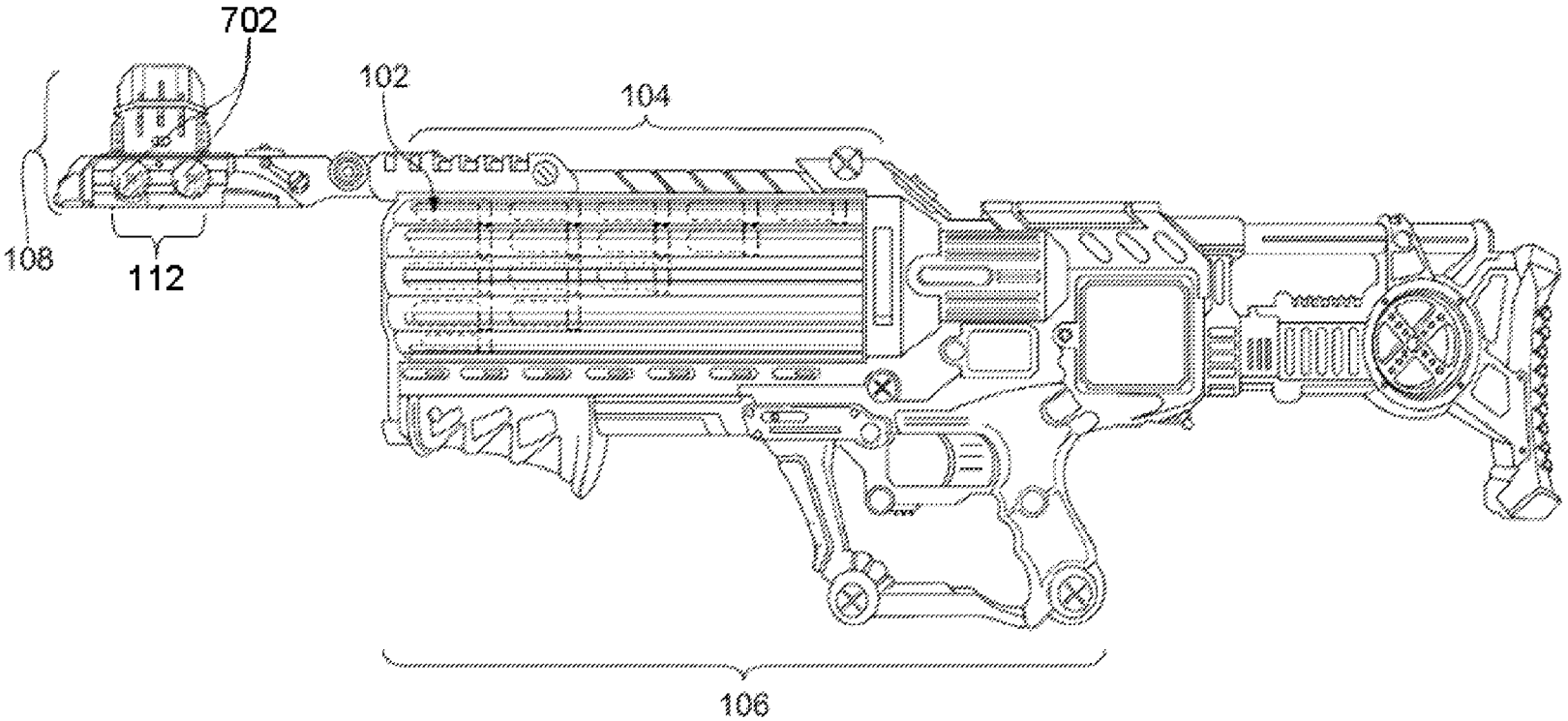

The invention generally relates to a toy launcher that can substantially safely launch a substantially large number of projectiles thereby reducing the number of times needed to reload the toy launcher. To increase the number of projectiles that can be launched, projectiles may be housed sequentially along the length of a plurality of receiving bodies of a rotatable projectile feed assembly. These housed projectiles can be launched out of the toy launcher in substantial synchronization with the rotation of the projectile feed assembly. This combination, inter alia, can allow the toy launcher to house a substantially large number of projectiles reducing the number of times needed to reload the toy launcher.

Referring to FIGS. 1A-1D, in exemplary embodiments, toy launcher 100 can house a substantially large amount (e.g., 40, 48, 60, 72, 100, 144, 200, 1000, etc.) of projectiles 102 in a projectile feed assembly 104 and a user, for example, interacting with a user interface assembly 106, can cause at least one projectile 102 to advance from projectile feed assembly 104 to a projectile launch assembly 108. At projectile launch assembly 108, at least one projectile 102 can interact with an at least one accelerator 112 causing at least one projectile 102 to be launched out of toy launcher 100.

Figure 1C:
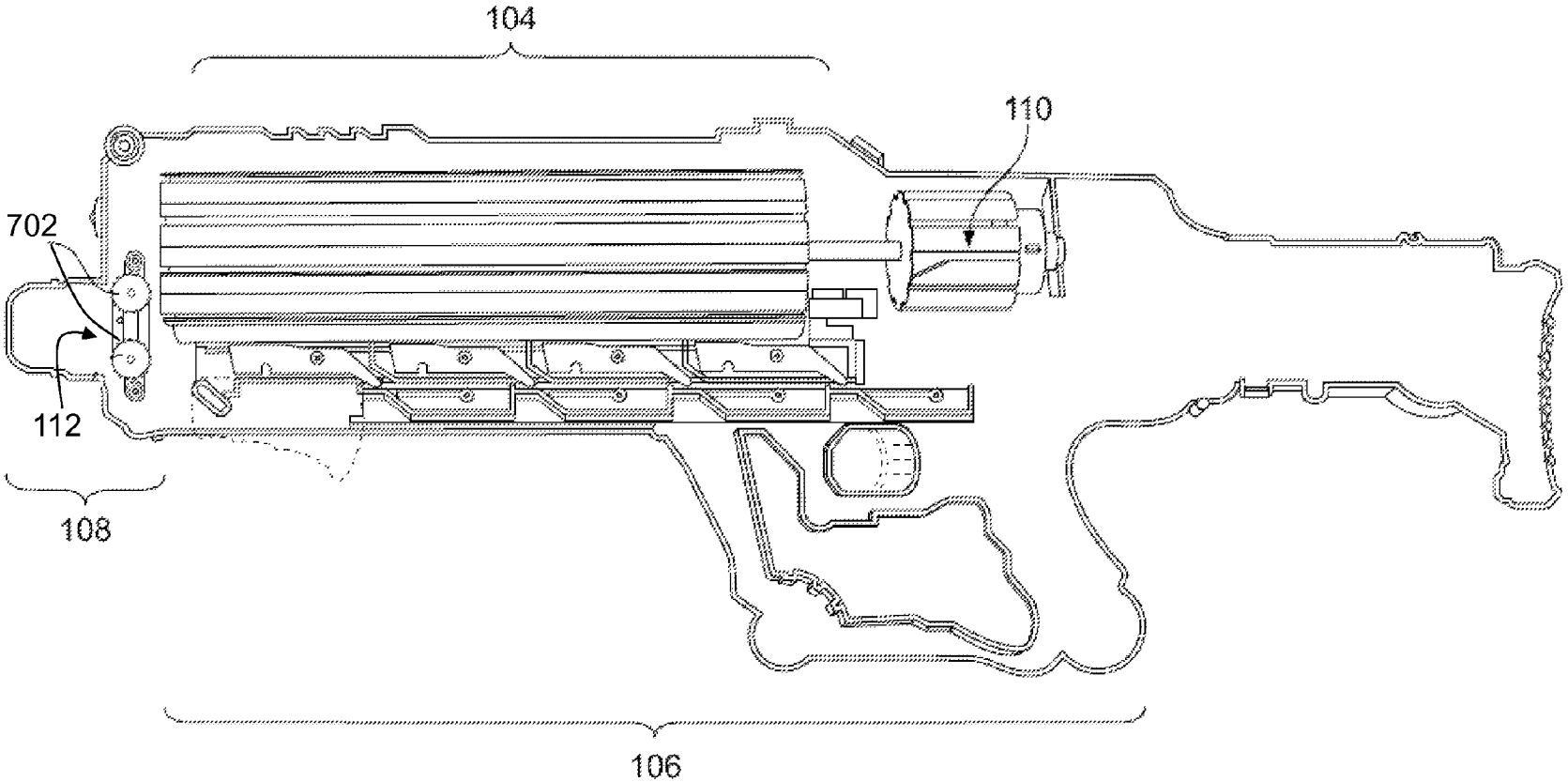
FIGS. 1C-1D illustratively depict various elements of the toy launcher, in accordance with exemplary embodiments of the present invention.
Figure 1D:
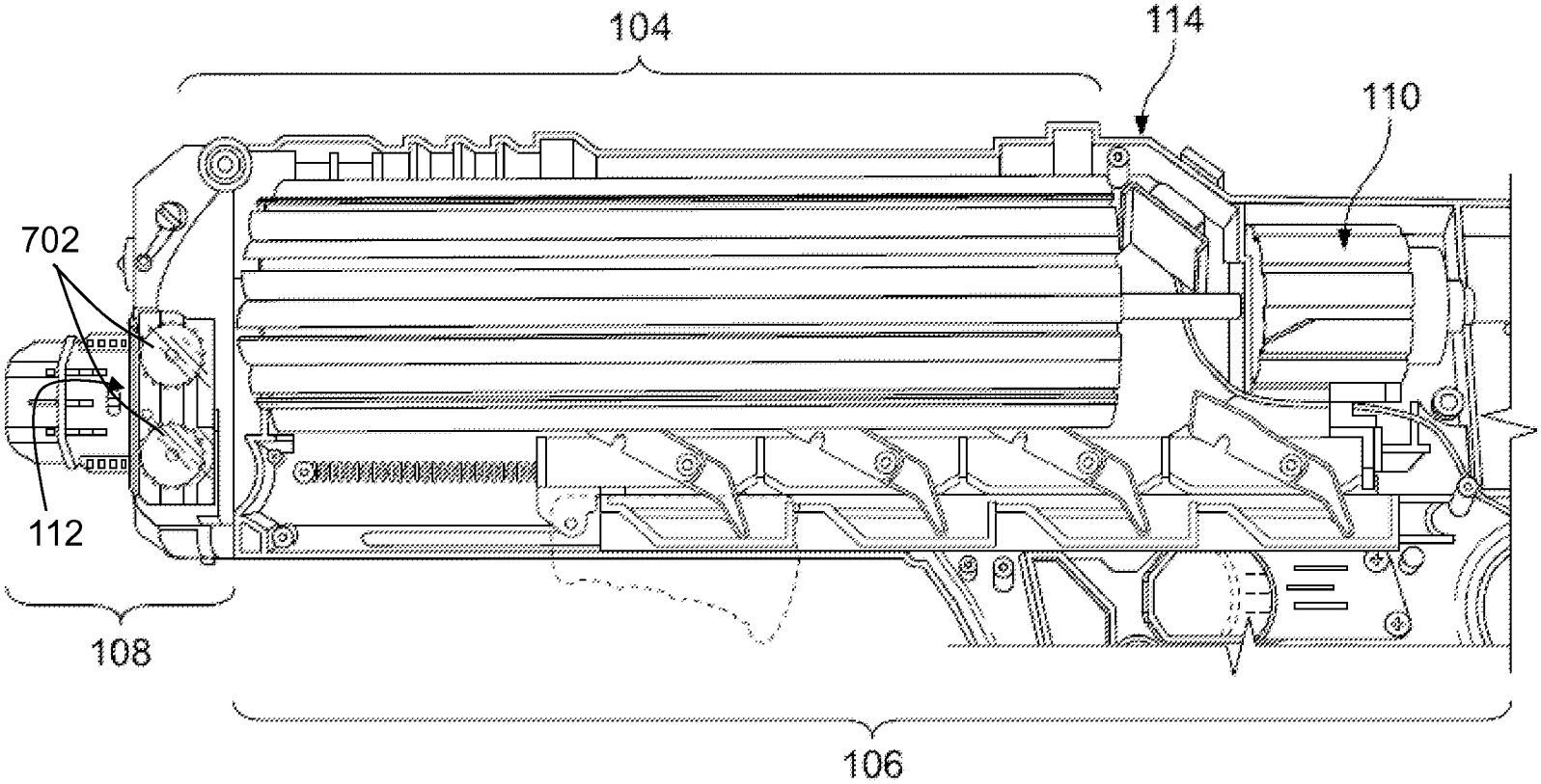

Referring to FIGS. 1C-1D, in exemplary embodiments, a plurality of projectiles 102 (not shown) can be stored sequentially along the length of projectile feed assembly 104 and projectile feed assembly 104 can rotate, for example, about its axis. This rotation can occur when user interface assembly 106 engages rotation mechanism 110 causing projectile feed assembly 104 to rotate. As pointed out above, the combination of being able to rotate and storing a plurality of projectiles 102 sequentially along the length of projectile feed assembly 104 can substantially increase the number of projectiles that can be safely launched out of toy launcher 100 thereby reducing the number of times needed to reload toy launcher 100.

Projectile feed assembly 104, user interface assembly 106, projectile launch assembly 108, rotation mechanism 110, and/or any other reasonable component of toy launcher 100 can be at least partially retained by a housing 114. Housing 114 alone, or in combination with feed assembly 104, user interface assembly 106, projectile launch assembly 108, rotation mechanism 110, and/or any other reasonable element of toy launcher 100 can be configured substantially to the shape of a gun and/or launcher, such as, but not limited to, a rocket launcher, grenade launcher, shoulder-launcher, and/or any reasonable form of launcher and/or can be constructed at least partially of plastic material, a metallic material, any combination thereof, and/or any other reasonably material for constructing a toy launcher.

Referring back to FIGS. 1A-1B, projectile launch assembly 108 can substantially separate from the remaining elements of toy launcher 100 (e.g., projectile feed assembly 104, user interface assembly 106, rotation mechanism 110, etc.) allowing access to projectile feed assembly 104 and/or projectile launch assembly 108. This separation can be for unclogging jammed projectiles 102 and/or substantially reducing the time required to reload toy launcher 100. It will be understood that toy launcher 100 can be reloaded without separating projectile launch assembly 108 from the remaining elements of toy launcher 100. For example, at least one element of projectile feed assembly 104 may be accessed by a user for reloading toy launcher 100.

Figure 2A:
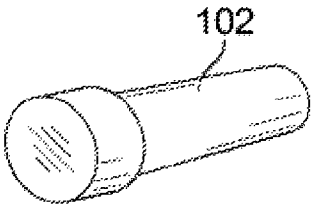
FIGS. 2A-2E illustratively depict various projectiles, in accordance with exemplary embodiments of the present invention.
Figure 2B:
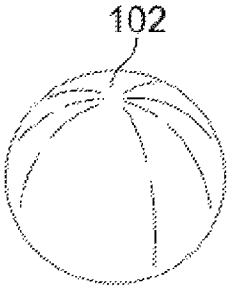
Figure 2C:
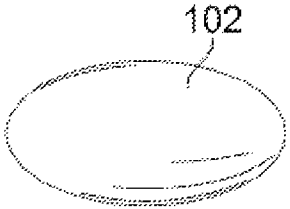
Figure 2D:
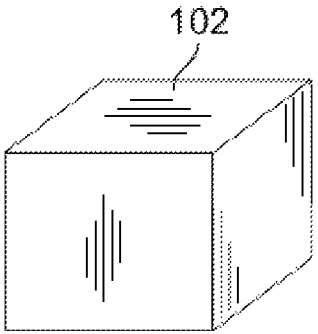
Figure 2E:
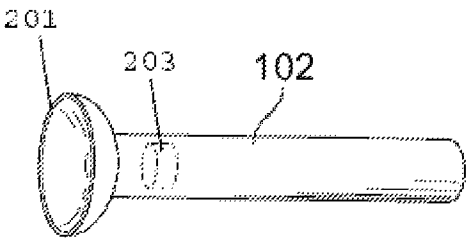

Referring to FIGS. 2A-2E, in exemplary embodiments, projectile 102 can be, but is not limited to, a dart such as dart/projectile 102 illustratively depicted in FIG. 2A; a round object such as round object/projectile 102 illustratively depicted in FIG. 2B; an ovoid object such as ovoid object/projectile 102 illustratively depicted in FIG. 2C; a polygonal object such as polygonal object/projectile illustratively depicted in FIG. 2C; an object including a suction cup 201 and/or a magnet 203 such as the object/projectile 102 illustratively depicted in FIG. 2D; and/or any reasonable object capable of being launched from toy launcher 100.

In exemplary embodiments, projectile 102 can be constructed of at least one material that may be rigid enough to be launched from toy launcher 100 and/or soft enough to avoid substantially injuring others. For example, projectiles 102 can be constructed of a substantially solid spongy cellular material such as, but not limited to, closed-cell polyethylene foam, open-cell polyethylene foam, ethylene vinyl acetate closed-cell foam, ethylene vinyl acetate open-cell foam, and/or any other reasonable material that may be rigid enough to be launch from toy launcher 100 and/or soft enough to avoid injuring others.

In exemplary embodiments, the dimensions of projectile 102 such as, but not limited to, length, width, and depth can be selected to substantially reduce the risk of injury. For example, the dimensions can be selected to reduce the chances of injuring a human eye. Further, materials used and/or methods for dimensioning projectile 102, toy launcher 100, and/or any element of toy launcher 100 may be based on safety standards such as, but not limited to, International Standardization Organization (ISO) 8124, European Union EN71, Hong Kong's Toys and Children's Products Safety Regulation, and the American Society for Testing and Materials (ASTM), to name a few.

Referring to FIGS. 3A-5, in exemplary embodiments, projectile feed assembly 104 can include a plurality of receiving bodies 302 arranged in a geometric pattern such that projectiles 102 (not shown) can be sequentially located along the length of receiving body 302. In exemplary embodiments, the length of receiving body 302, projectile 102's dimensions, and/or the number of receiving bodies can be selected to, for example, increase the quantity of projectiles that can be launched from toy launcher 100 without reloading. By way of example, projectile feed assembly 104 can include twelve (12) receiving bodies, each having a length of about ten and a half inches (10.5"), and projectiles 102 housed sequentially therein can have a length of about two and a half inches (2.5"). Thus, toy launcher 100 can have about forty-eight (48) projectiles 102.

Figure 3A:
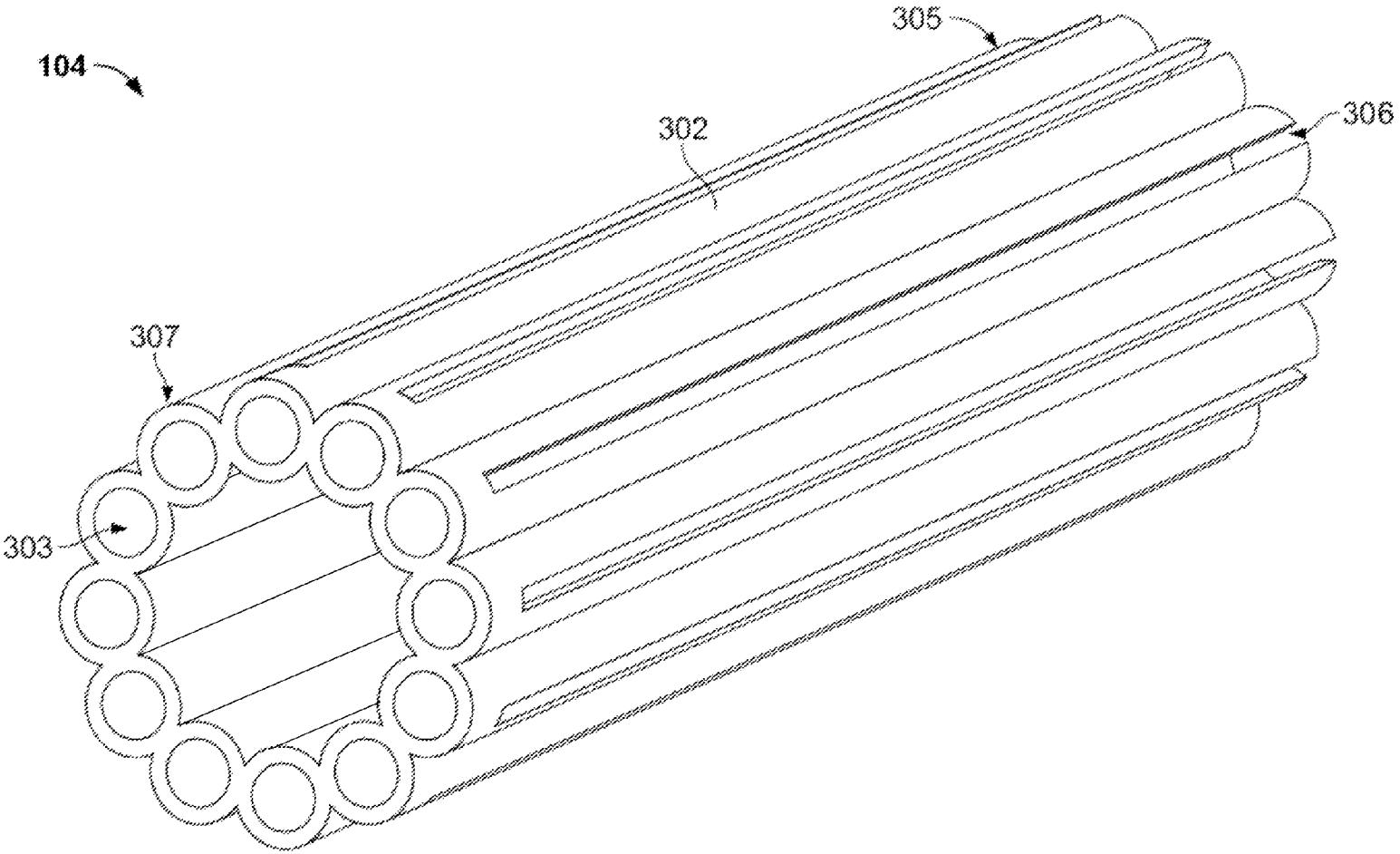
FIGS. 3A-5B illustratively depict various configurations for projectile feed assemblies, in accordance with exemplary embodiments of the present invention.

Referring to FIG. 3A, in exemplary embodiments, projectile feed assembly 104 can include a plurality of receiving bodies 302 having an opening 303 extending from a proximal end 305 (i.e., the end nearer to the user when located in toy launcher 100) to a distal end 307 (i.e., the end further from the user when located in toy launcher 100) of projectile feed assembly 104. In exemplary embodiments, projectile feed assembly 104 can be constructed of a plurality of receiving bodies 302 affixed and/or coupled together. It will be understood that any reasonable technique can be used to create projectile feed assembly 104 and receiving bodies 302. For ease, projectile feed assembly 104 is, at times, described as being constructed from a plurality of receiving bodies 302. This is merely for ease and is in no way meant to be a limitation.

In exemplary embodiments, the cross-sectional shape of receiving body 302 and/or the cross-sectional shape of opening 303 can be, but is not limited to, round, square, polygonal, triangular, star shaped, any combination thereof, or any other reasonable shape capable of receiving projectile 102. For ease, the cross-sectional shape of each receiving body 302 and opening 303 are, at times, depicted as round and/or receiving body 302 is depicted as a tube/tubular. This is merely for ease and is in no way meant to be a limitation.

Figure 3B:
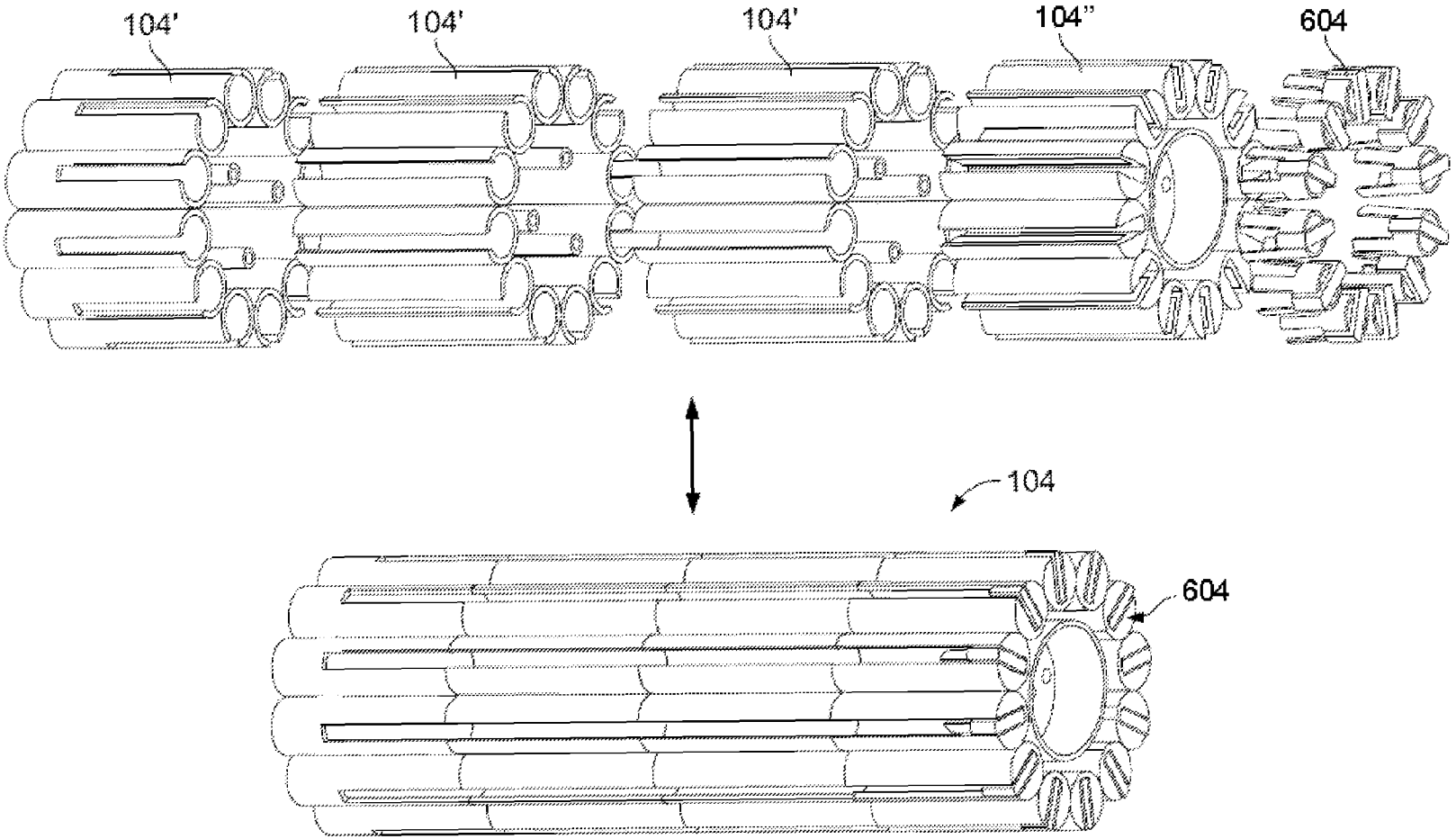
Figure 4A:
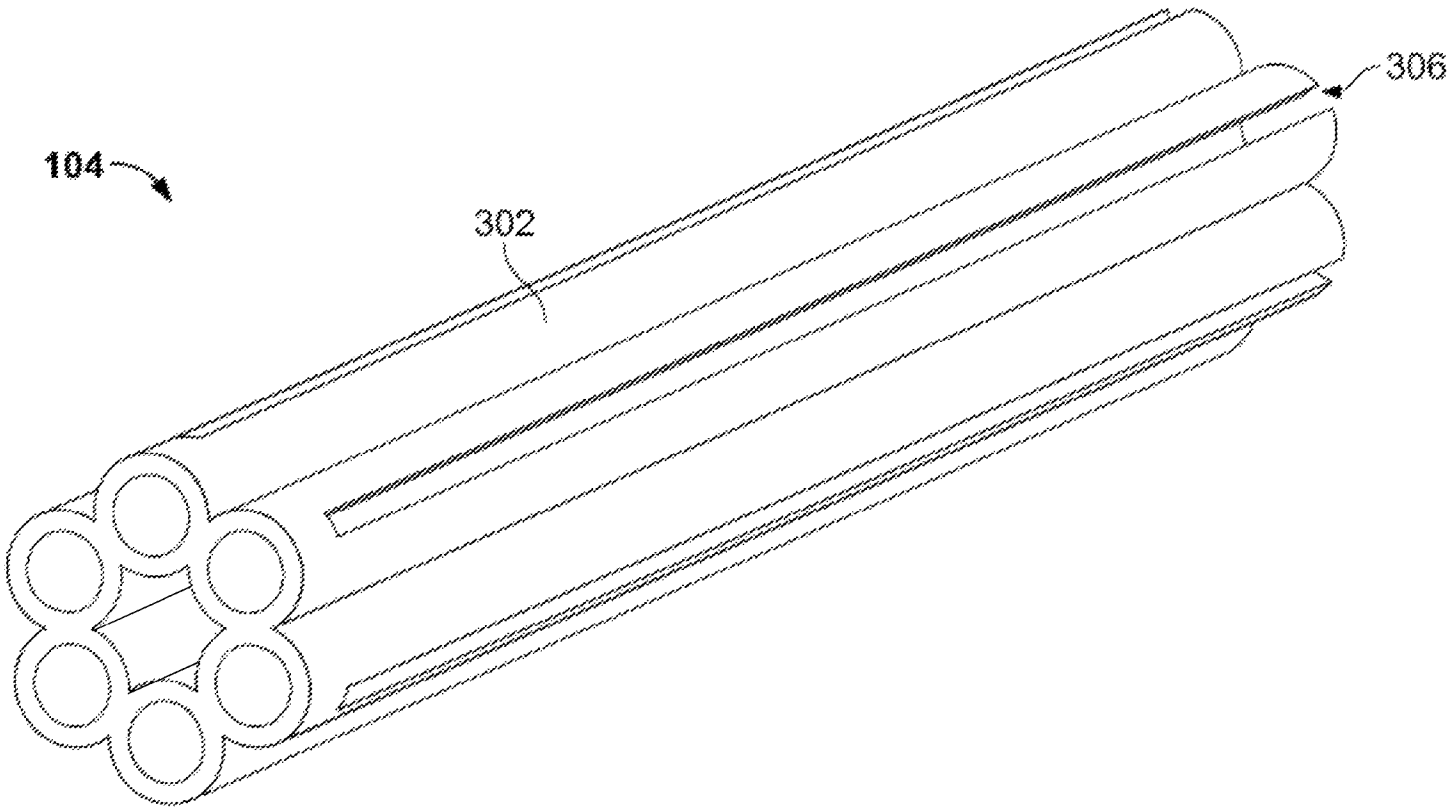
Figure 4B:
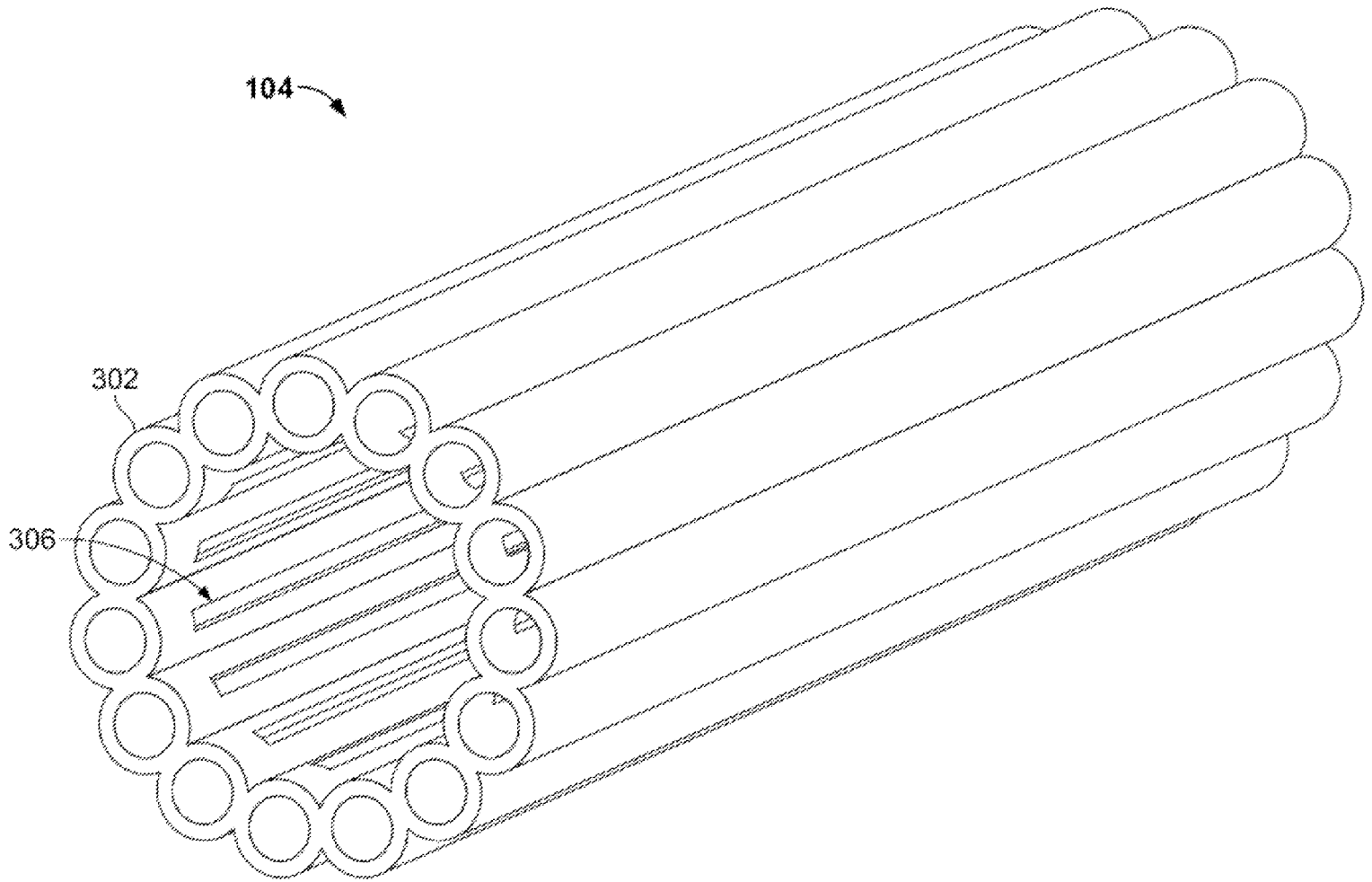
Figure 5A:
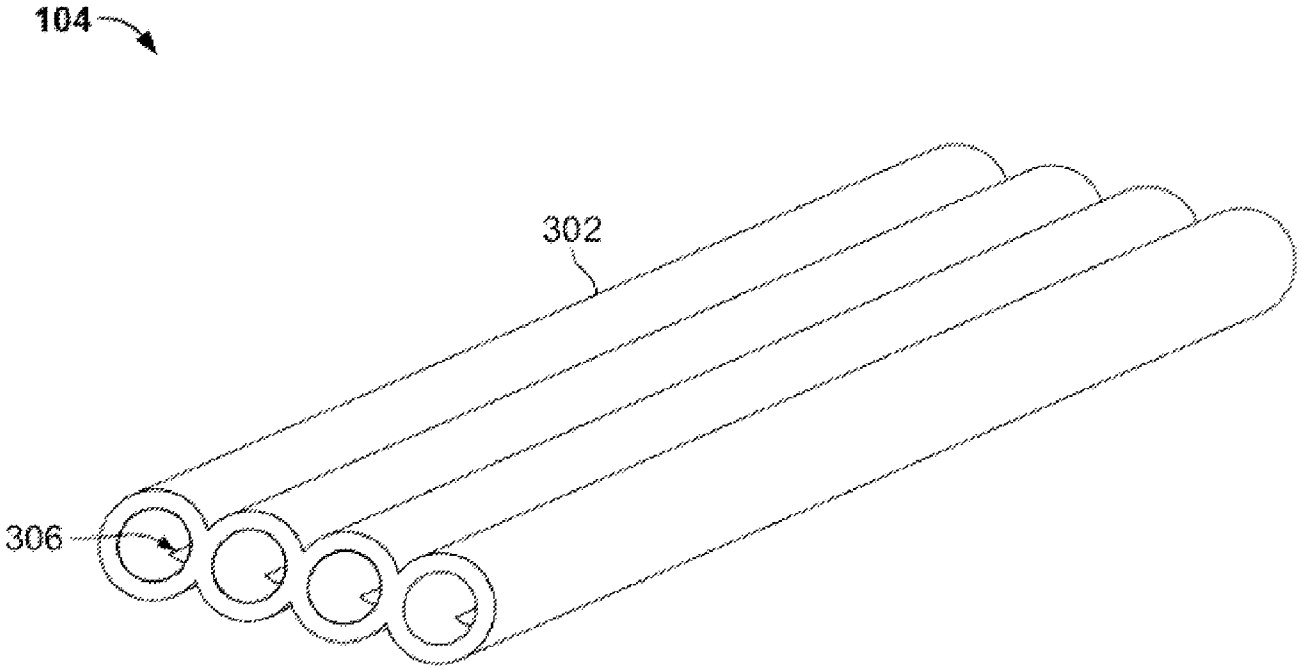
Figure 5B:
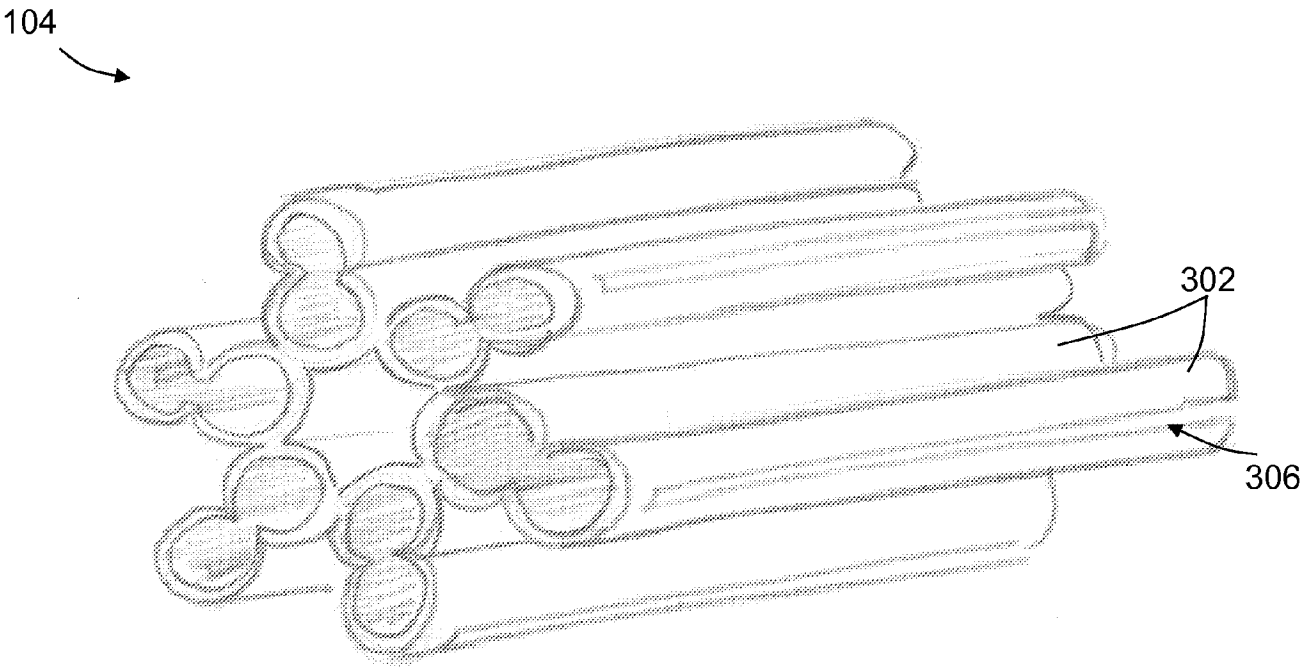

Referring to FIG. 3B, in exemplary embodiments, one or more projectile feed sub-assemblies 104' and/or sub-assemblies 104" can be combined together to create a substantially singular projectile feed assembly 104. Further, at least one projectile advancer 604 (discussed in more detail below) can be placed into one or more projectile feed sub-assemblies 104' and/or sub-assemblies 104" combined together to create a substantially singular projectile feed assembly 104. A plurality of projectile feed sub-assemblies 104' and/or sub-assemblies 104'" can be combined to create projectile feed assembly 104 to, for example, reduce construction costs and/or ease construction. Further, in exemplary embodiments, additional projectile feed assemblies may be added to increase the length of projectile feed assembly 104 such that additional projectiles 102 can be housed in projectile feed assembly 104.

In exemplary embodiments, projectile feed assembly 104 can include any reasonable quantity of receiving bodies 302. For example, referring to FIG. 3A projectile feed assembly 104 is illustratively depicted having twelve (12) receiving bodies 302; referring to FIG. 4A, projectile feed assembly 104 is illustratively depicted having six (6) receiving bodies 302; referring to FIG. 4B, projectile feed assembly 104 is illustratively depicted having fifteen (15) receiving bodies 302; and referring to FIG. 5A, projectile feed assembly 104 is illustratively depicted having four (4) receiving bodies 302. It will be understood that projectile feed assembly can include as few receiving bodies as one to as many hundreds and/or thousands of receiving bodies. The quantity of receiving bodies 302 may be increased such that additional projectiles can be housed in toy launcher 100.

In exemplary embodiments, the arrangement of a plurality of receiving bodies 302 can form a geometric pattern such as, but not limited to, circular, polygonal, linear, star-shaped, and/or any other reasonable shape capable of being used in toy launcher 100. For example, referring to FIGS. 3A-4B, a plurality of receiving bodies 302 are illustratively depicted forming a substantially circular shape; referring to FIG. 5A, a plurality of receiving bodies 302 are illustratively depicted forming a substantially linear shape; and referring to FIG. 5B, a plurality of receiving bodies 302 are illustratively depicted forming a star shape.

It will be understood that any of the techniques described herein can be used and/or modified such that toy launcher 100 can function with different shaped receiving bodies 302 and/or projectile feed assembly 104 without deviating from the scope of the invention. For example, rather than rotating projectile feed assembly 104, as described at times herein, projectile feed assembly 104 may translate back and forth, up and down, any combination thereof, and/or move by any reasonable technique and/or in any reasonable direction that can allow projectiles to advance through a plurality of receiving bodies.

In exemplary embodiments, receiving body 302 can include at least one interfacing region 306 and interfacing region 306 can be located at any reasonable location along receiving body 302. For example, referring to FIGS. 3A-4A interfacing region 306 is illustratively depicted on the outside facing surface of receiving bodies 302 and referring to FIG. 4B interfacing region 306 is illustratively depicted on the inside facing surface of receiving bodies 302. For ease, at times, interfacing region 306 is only illustratively depicted on the outside facing surface of receiving bodies 302. This is merely for ease and is in no way meant to be a limitation.

Further, interfacing region 306 can be, but is not limited to, at least one slot that can extend at least some length of receiving body 302, at least one opening in receiving body 302, and/or any reasonable gap, opening, and/or passage that can allow projectiles housed in receiving body 302 to be engaged. For ease, at times, interfacing region 306 is illustratively depicted as slot extending substantially the length of receiving body 302. This is merely for ease and is in no way meant to be a limitation.

Further still, in exemplary embodiments, at least one receiving body 302 can be accessed by at least one interfacing region 306 such that at least one projectile 102 housed in a receiving body can be accessed and/or such that a plurality of projectiles 102 housed in a plurality of receiving bodies can be accessed and/or such that a plurality of projectiles 102 housed in a single receiving body can be accessed. In exemplary embodiments, a plurality of receiving bodies can be arranged such that more than one projectile can be launched at substantially the same time and/or in rapid succession. For example, referring to FIGS. 4A-5A, a single receiving body 302 can be accessed via a single interfacing region 306 such that only projectiles housed in that receiving body can be accessed. As another example, referring to FIG. 5B, a plurality of receiving bodies 302 can be accessed via a single interfacing region 306 such that a plurality of projectiles housed in a plurality of receiving bodies can be accessed.

It will be understood that any number of receiving bodies can be accessed by any number of interfacing regions. For ease, at times, only one or two receiving bodies are described as being accessed. This is merely for ease and is in no way meant to be a limitation. Further, it will be understood that any of the techniques used for one receiving body being accessed can similarly be used for two or more receiving bodies being accessed and any of the techniques used for two receiving bodies being accessed can similarly be used for one receiving body being accessed.

In exemplary embodiments, projectiles 102 can be housed sequentially along the length of a projectile receiving body 302 such that when force is applied on a proximally located projectile 102 a distally located projectile 102 housed in that same projectile receiving body can be driven forward. This forward driving can cause at least one projectile 102 nearer to the exit of toy launcher 100 (i.e., the most distally located projectile 102 housed in that projectile receiving body 302) to be launched from toy launcher 100. Further, between, before, and/or after at least one projectile 102 is launched from toy launcher 100, projectile feed assembly 104 can rotate. For ease, at times, this rotation is not described and/or described separately. This is merely for ease and is in no way meant to be a limitation.

In exemplary embodiments, projectiles 102 housed in projectile receiving bodies 302 can be advanced using any reasonable technique such as, but not limited to, air compression, at least one engagement mechanism, a plurality of rotating bodies, a rotating tread/track assembly, and/or by any reasonable technique capable of imparting a force directly and/or indirectly on projectile 102 causing at least one projectile 102 to advance through projectile feed assembly 104. For example, using air compression, at least one projectile 102 housed in a projectile receiving body 302 can be advanced by applying a positive air pressure behind projectile 102 and/or a negative air pressure in front of projectile 102. This positive air pressure may be provided by at least one of a compressed air chamber and/or air compressor.

As another example, using a plurality of rotating bodies, at least one projectile 102 housed in a projectile receiving body 302 can be advanced by, for example, a plurality of mechanically driven rollers located along at least some of the length of projectile receiving body 302. As yet another example, using a tread/track assembly, at least one projectile 102 housed in a projectile receiving body 302 can be advanced by being placed on a mechanically driven tread/track extending along at least some of the length of projectile receiving body 302.

As still another example, using at least one engagement mechanism, at least one projectile 102 housed in a projectile receiving body 302 can be advanced by having a force applied behind and/or along at least some length of projectile 302 by at least one engagement mechanism. Further, using at least one engagement mechanism, a plurality of projectiles 102 housed in a plurality of projectile receiving bodies 302 can be advanced, for example, substantially simultaneously, by having a force applied behind and/or along at least some length of projectile 302 by at least one engagement mechanism. The engagement mechanism can, for example, extend from the proximal end 305 of an opening 303 to the rear of a projectile 302; extend at least partially through interfacing region 306 to the rear and/or side of projectile 302; and/or extend at least partially through interfacing region 306 to the rear and/or side of projectile 302.

Figure 6A:
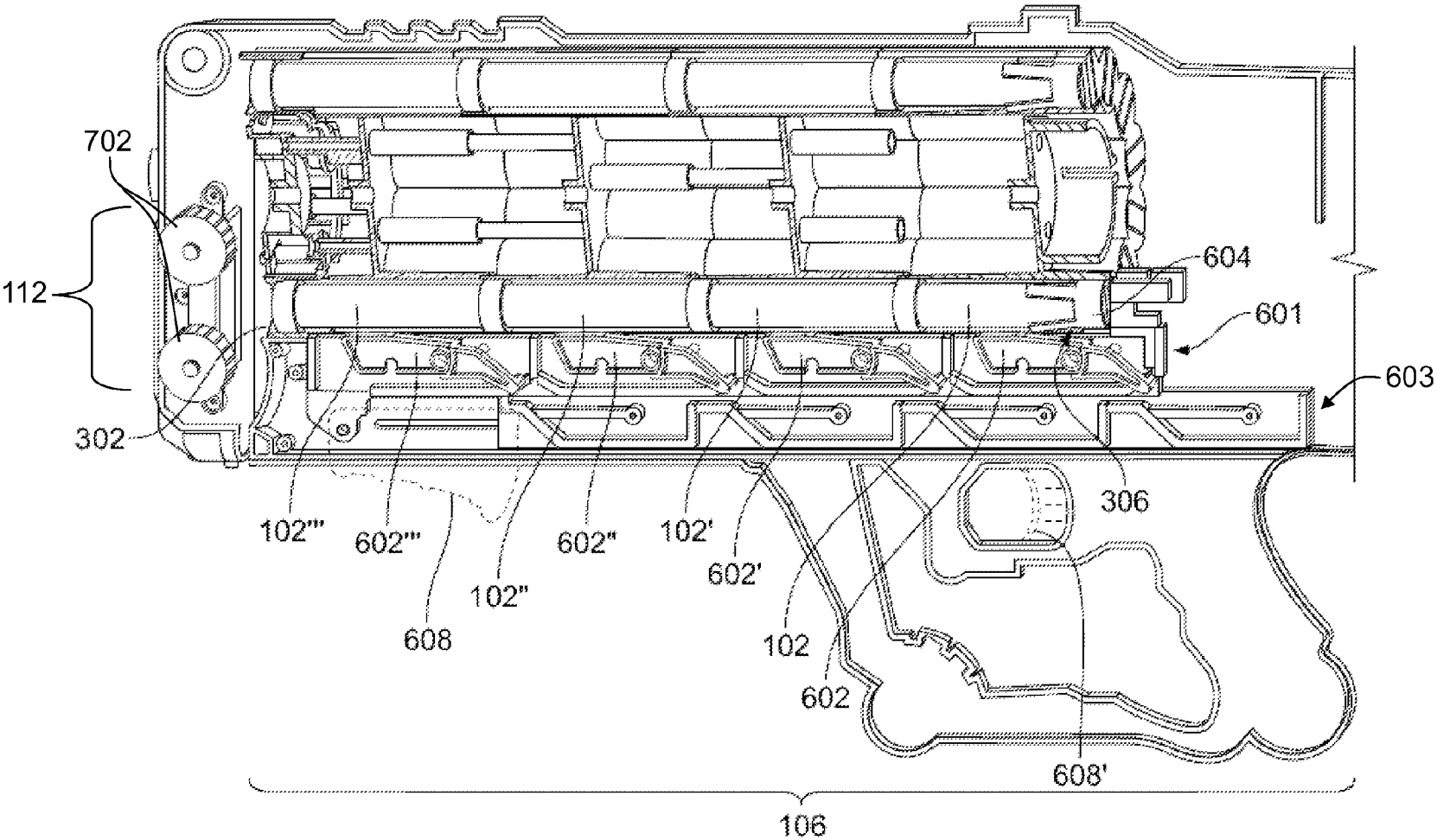
FIGS. 6A-6L illustratively depict projectiles advanced in a receiving body of a projectile feed assembly, in accordance with exemplary embodiments of the present invention.
Figure 6B:
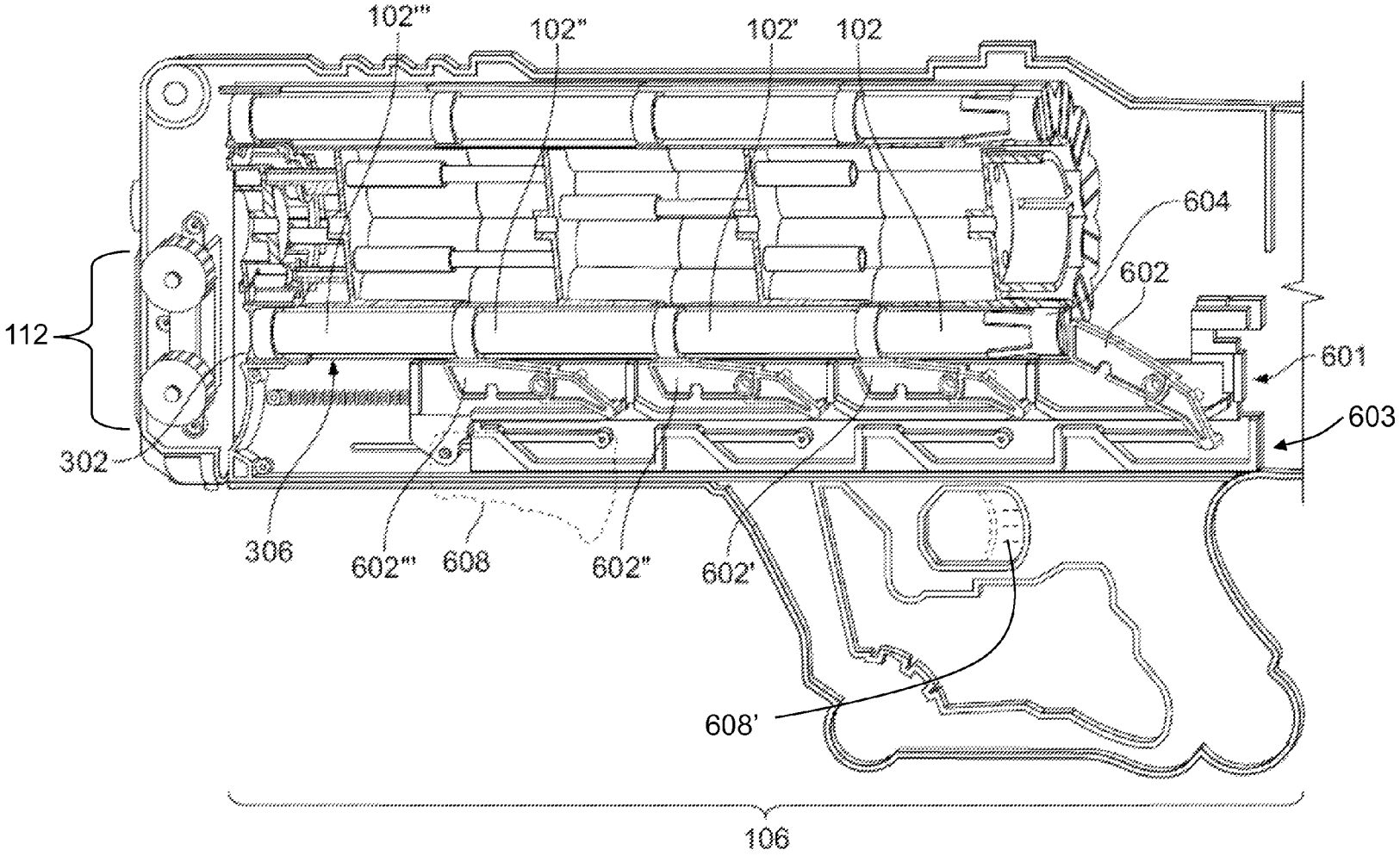
Figure 6C:
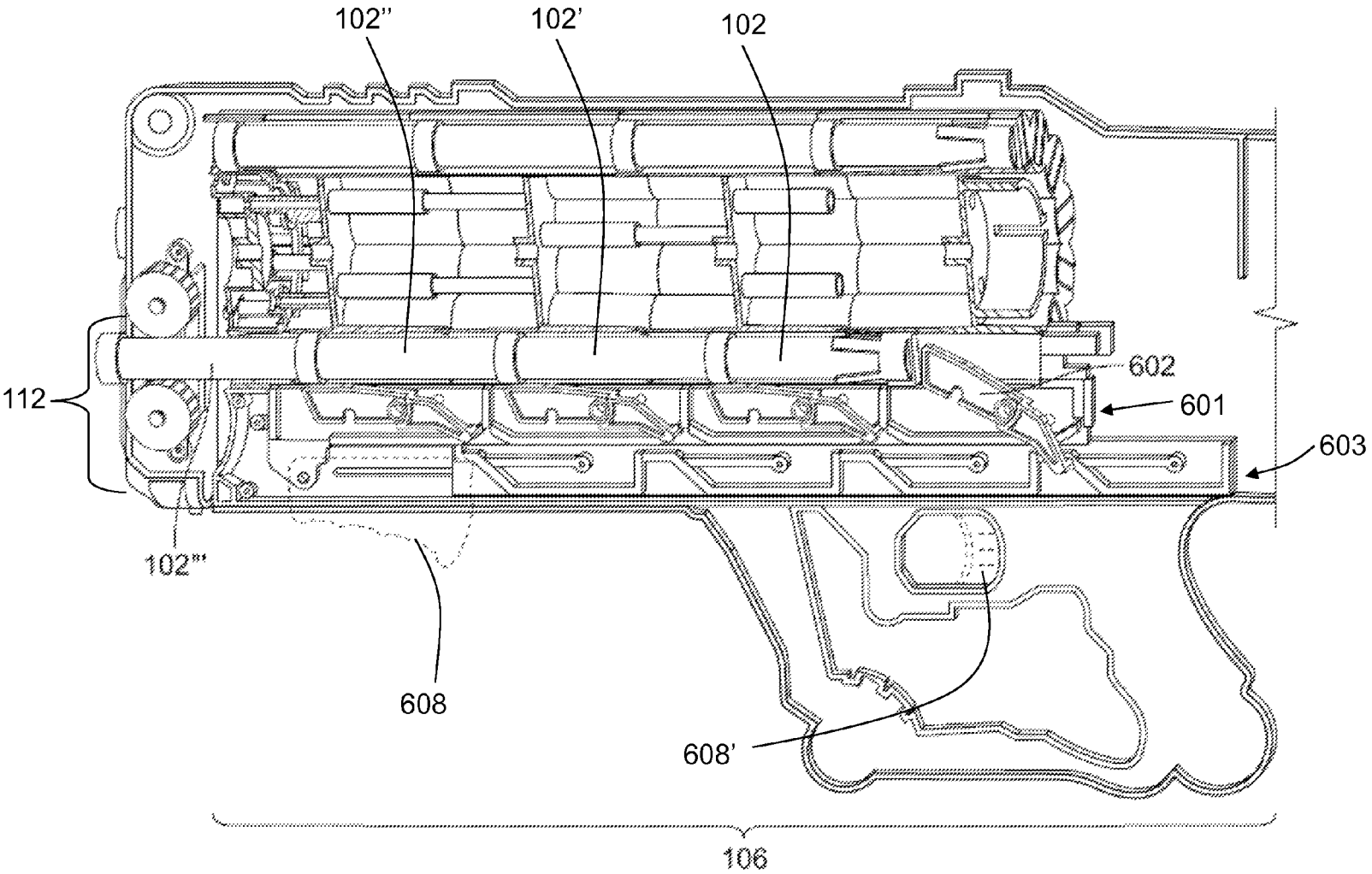
Figure 6D:
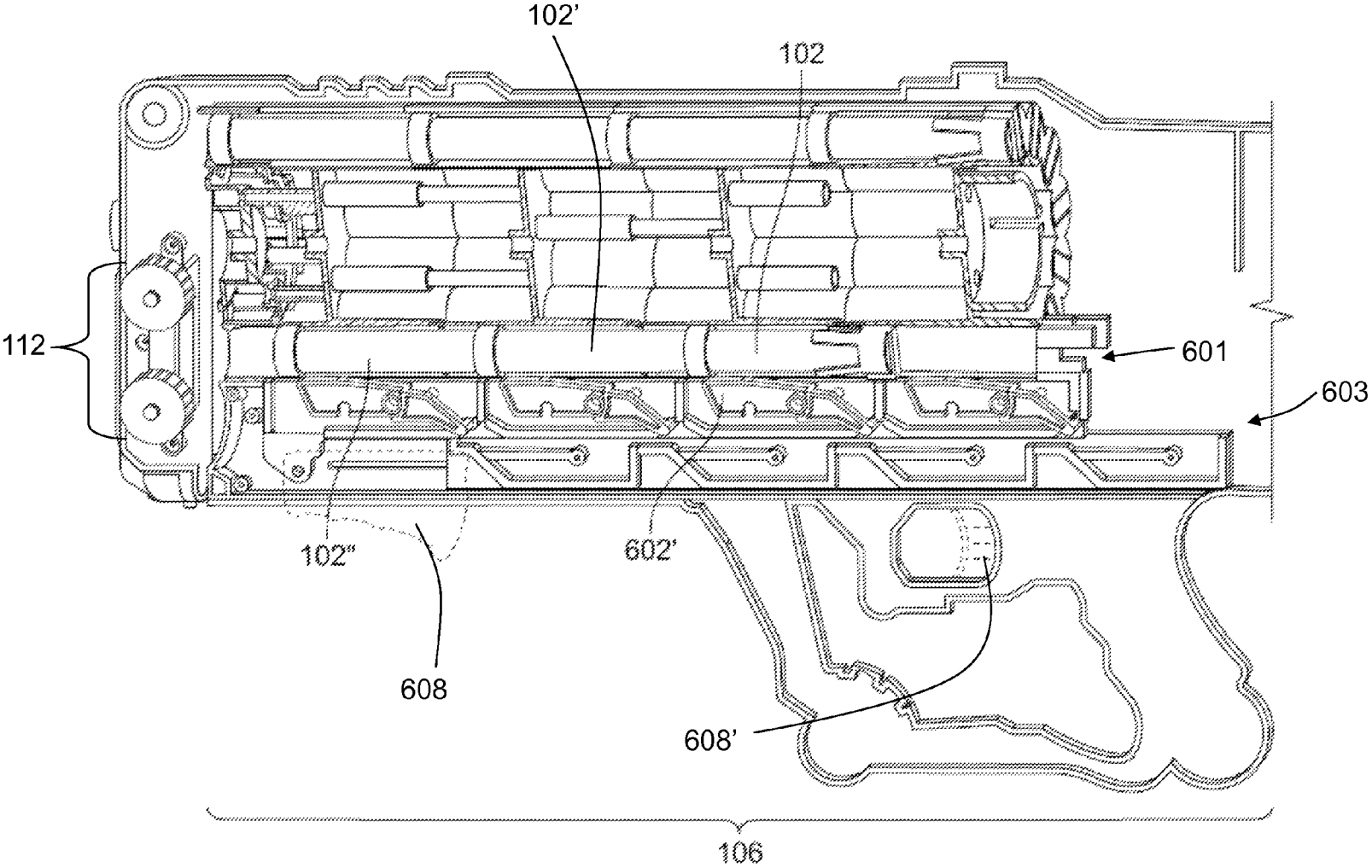
Figure 6E:
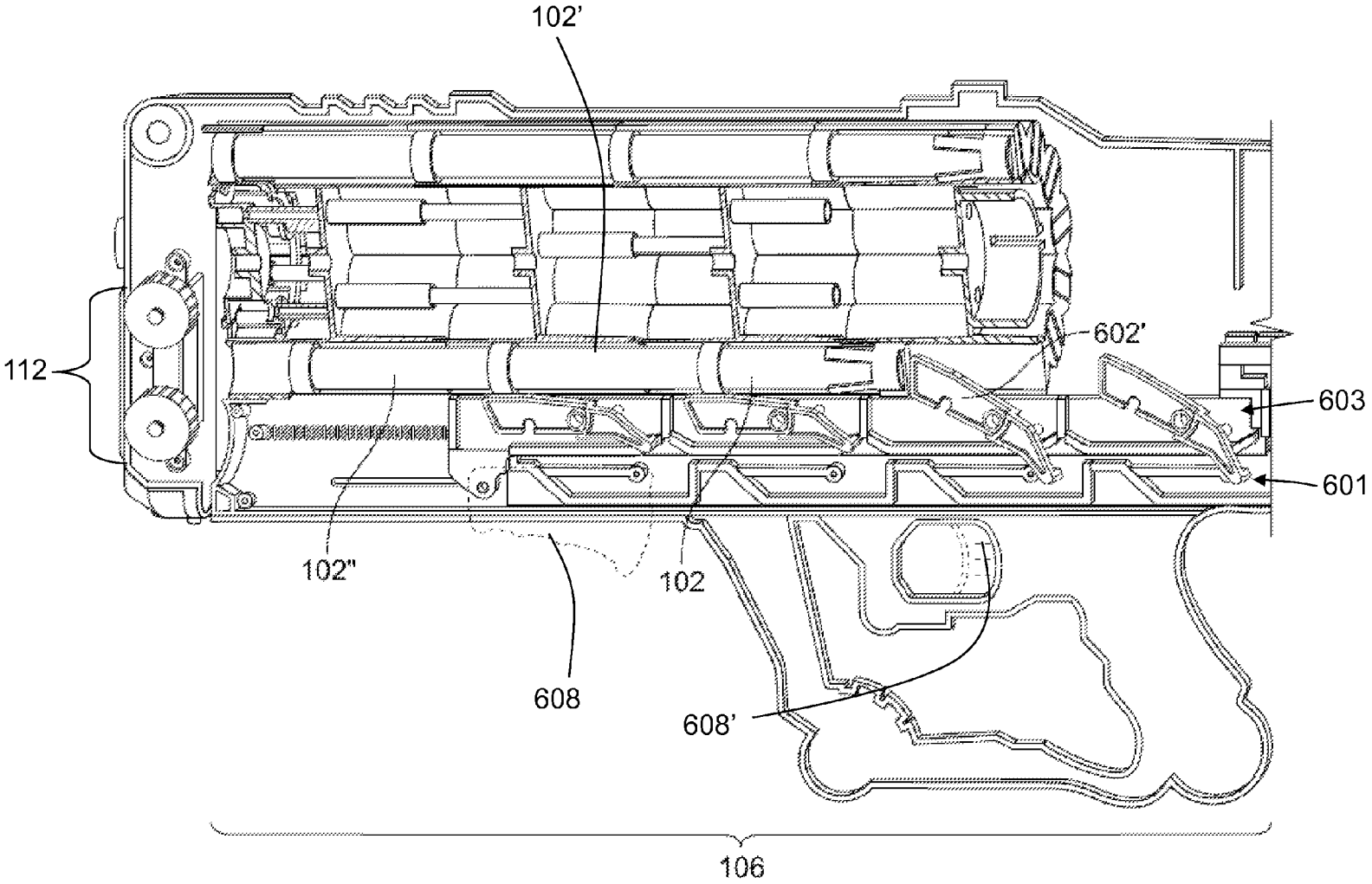

Referring to FIGS. 6A-6L, in exemplary embodiments, at least one technique for advancing projectiles 102 through projectile feed assembly 104 using a plurality of engagement mechanisms 602 extending at least partially through interfacing region 306 is illustratively depicted. By way of example, referring to FIG. 6A-6B, during use slide rack assembly 601 can be driven in a proximal/rearward direction (e.g., by the user moving user interface 608 in a reward proximal/direction) causing engagement mechanisms 602 to pivot/rotate in a first direction. Referring to FIG. 6B, when pivoted, engagement mechanism 602 can extend substantially through interfacing region 306 and engage projectile advancer 604 at a first location. Referring to FIG. 6C, with projectile advancer 604 engaged, slide rack assembly 601 can be driven in a distal/forward direction advancing projectiles 102 to a second location thereby causing projectile 102''' to interact with accelerator 112 such that projectile 102''' can be launched from toy launcher 100. Referring to FIG. 6D, after advancing projectile 102 to the second location, engagement mechanisms 602 can then pivot/rotate in a second direction thereby restarting the process such that at least one more projectile 102 can be launched from toy launcher 100.

It will be understood that before restarting the process, as discussed below, projectile feed assembly 104 can rotate and/or translate such that a different receiving body 302 can be accessed to advance projectiles 102. Further, these different projectiles may be at any location along the length of receiving body 302 and can be accessed and advanced using the techniques described herein and/or using any other reasonable technique. Further, any reasonable number of engagement mechanisms can be used to advance projectile 102. For ease, at times, only four engagement mechanisms are depicted. This is merely for ease and is in no way meant to be a limitation.

It will be understood that any number of projectiles 102 can be advanced and/or launched from toy launcher 100 between rotations and/or translations of projectile feed assembly 104. For example, one, more than one and/or all of the projectiles housed in at least one receiving body 302 can be advanced and/or launched from toy launcher 100 between rotations and/or translations of projectile feed assembly 104. Further, a user may have the option of advanced and/or launched one, more than one and/or all of the projectiles housed in at least one receiving body 302 from toy launcher 100 between rotations and/or translations of projectile feed assembly 104. For ease, it is depicted, at times, that a single projectile 102 is launched between rotations and/or translations of projectile feed assembly 104. This is merely for ease and is in no way meant to be a limitation.

It will be understood that either of projectile feed assembly 104 and any remaining number of elements of launcher 100 can rotate and/or translate relative to each other. For example, projectile feed assembly 104 can rotate and/or translate relative to accelerator 112, accelerator 112 can rotate and/or translate relative to projectile feed assembly 104, and/or any remaining element(s) of launcher 100 can rotate and/or translate relative to projectile feed assembly 104 and/or any other remaining element(s) of launcher 100. For ease, projectile feed assembly 104 is depicted, at times, as rotating and/or translating relative to accelerator 112. This is merely for ease and is in no way meant to be a limitation.

Figure 6F:
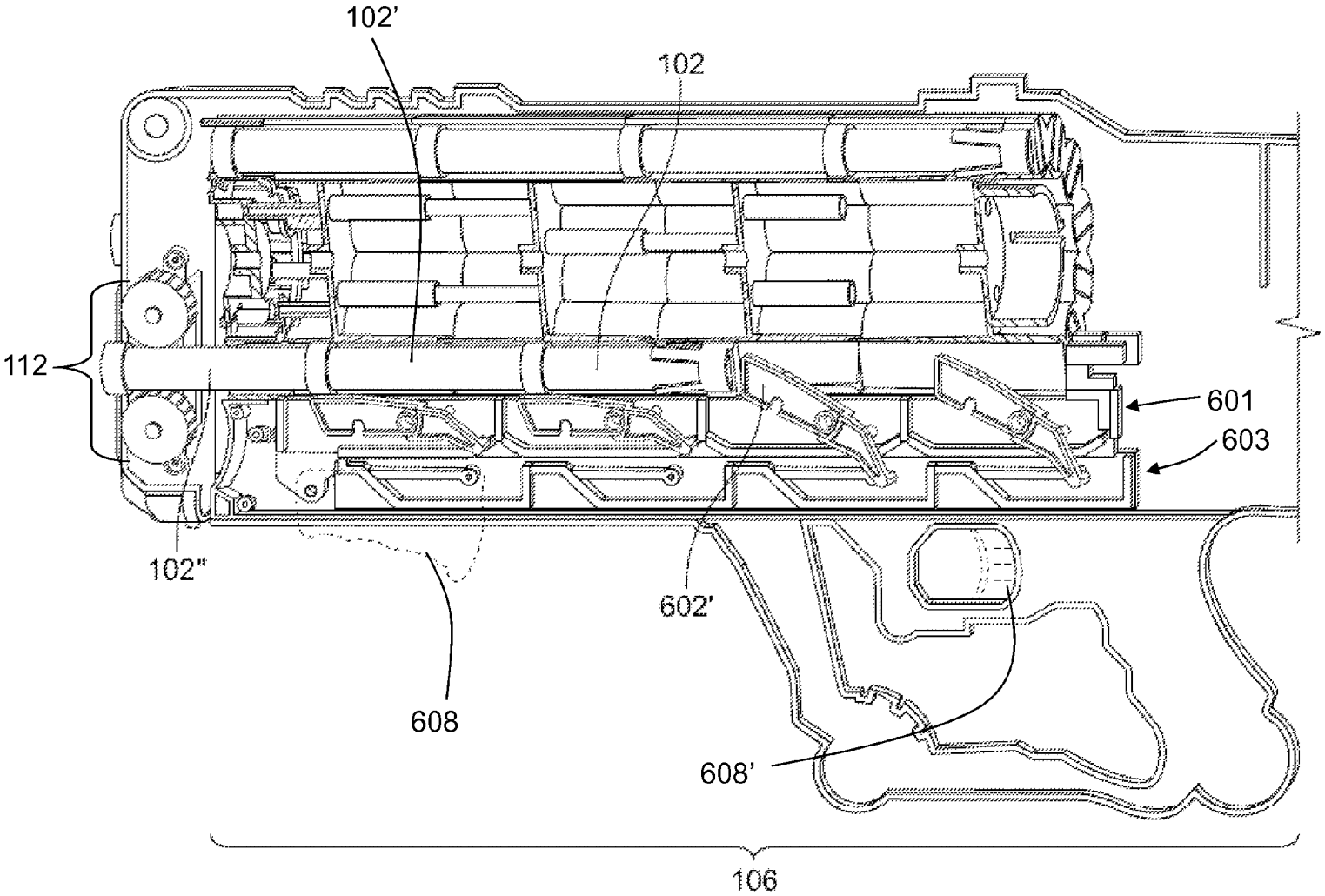
Figure 6G:
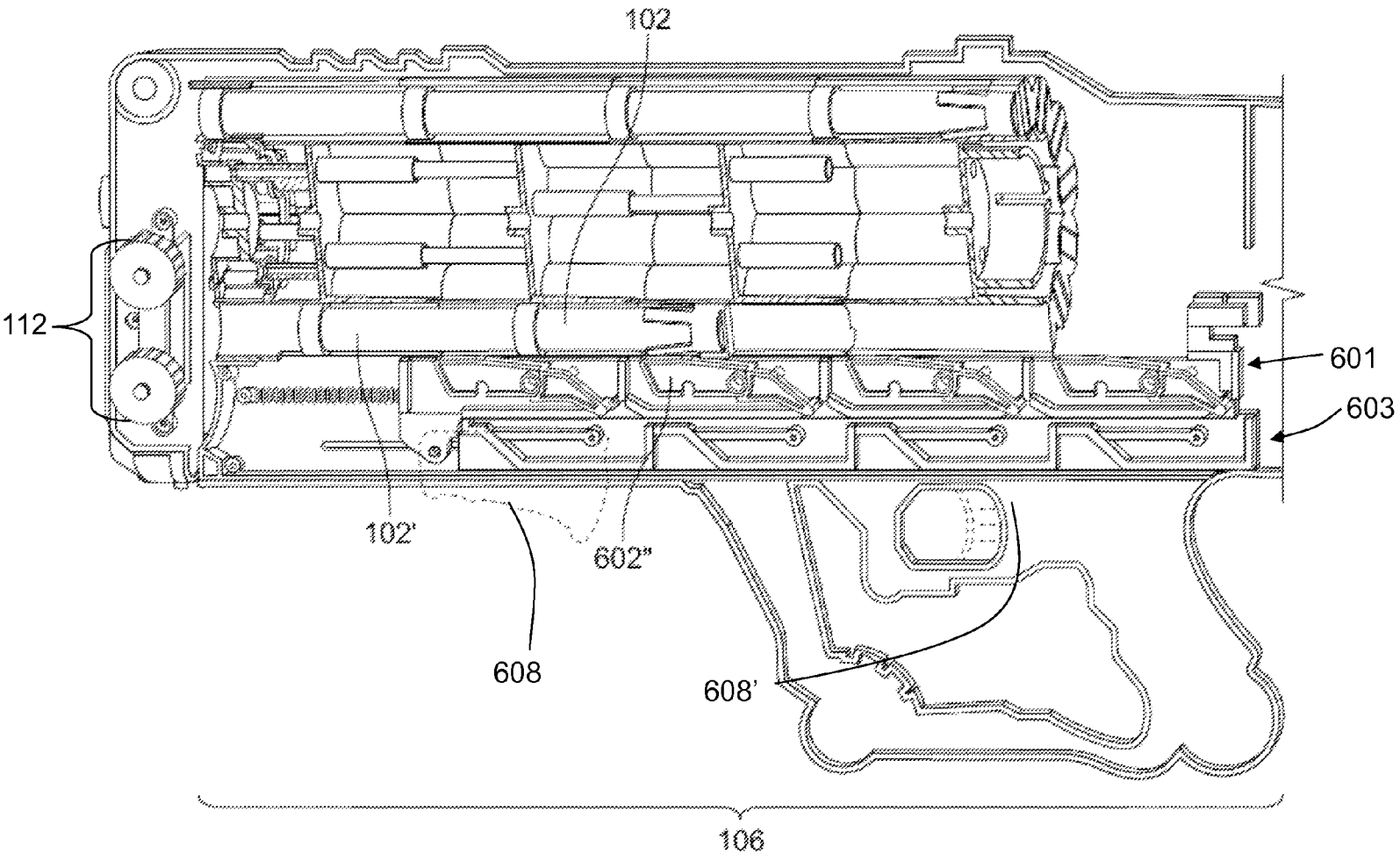

Referring to FIGS. 6D-6G, in some instances, when the process is restarted a different second engagement mechanism 602' can engage projectile advancer 604 which has advanced to second location. For example, referring to FIG. 6E, slide rack assembly 601 can be driven in a proximal/rearward direction (e.g., by rearward movement of user interface 608) causing a second engagement mechanisms 602' to pivot/rotate in the first direction into engagement with projectile advancer 604. Referring to FIG. 6F, when pivoted the second engagement mechanism 602' can engage projectile advancer 604 which has advanced to second location. With projectile advancer 604 engaged, slide rack assembly 601 can be driven in the distal/forward direction driving projectile 102 to a third position thereby causing projectile 102" to interact with accelerator 112 such that projectile 102" can be launched from toy launcher 100. Referring to FIG. 6G, after advancing projectile 102 to a third position, the second engagement mechanisms 602' can then pivot/rotate in the second direction thereby restarting the process such that at least one more projectile 102 can be launched from toy launcher 100.

Figure 6H:
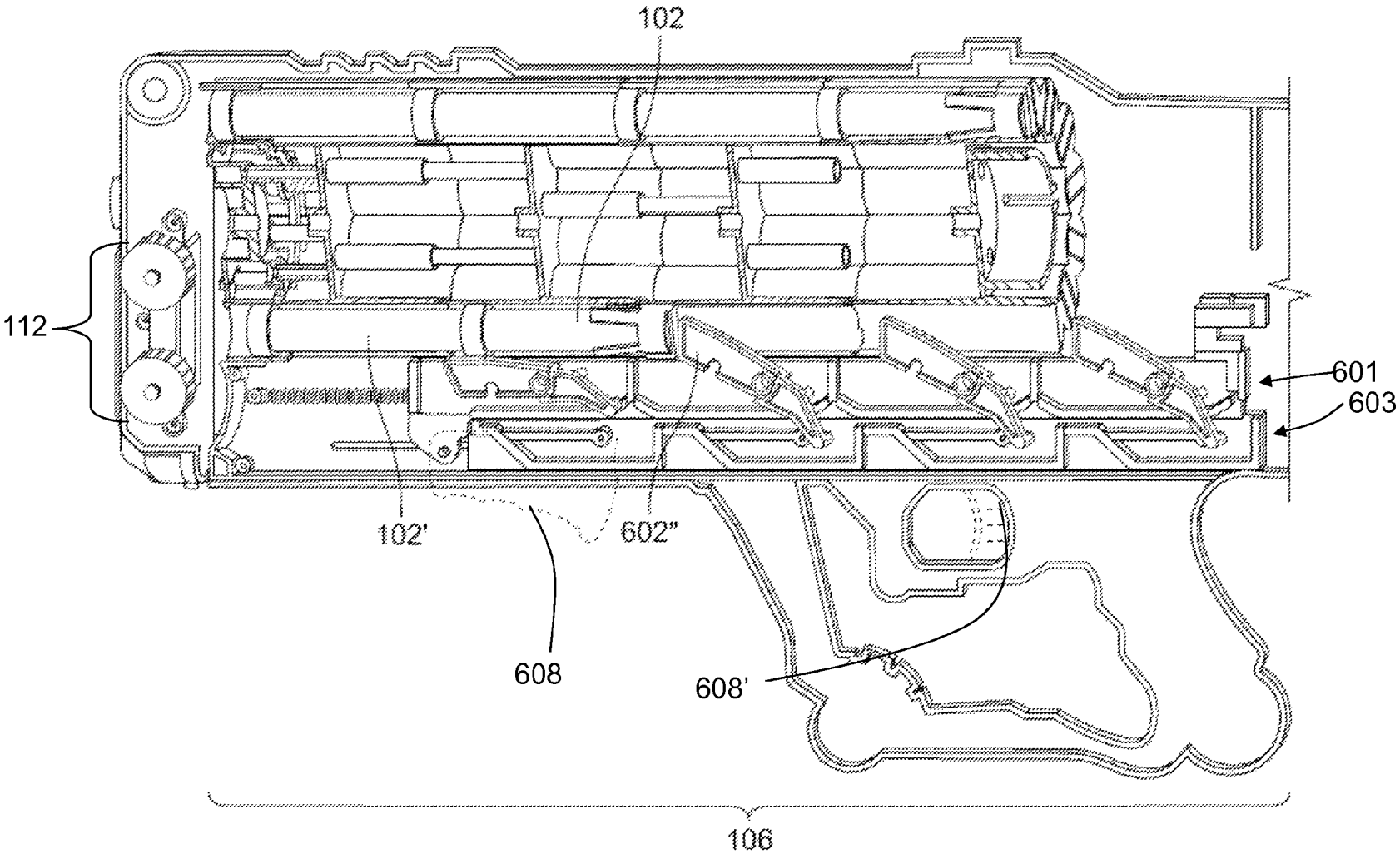
Figure 6I:
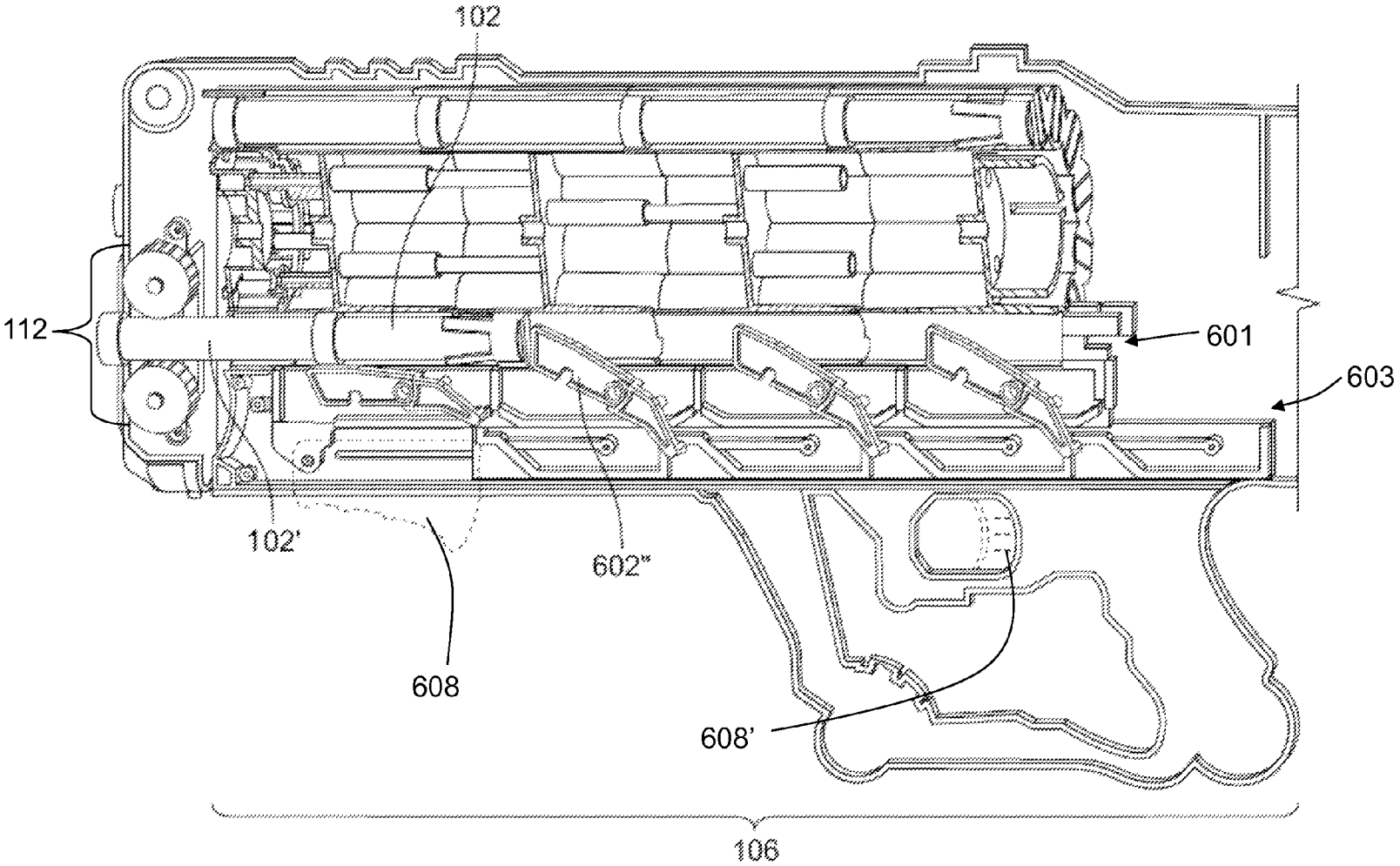
Figure 6J:
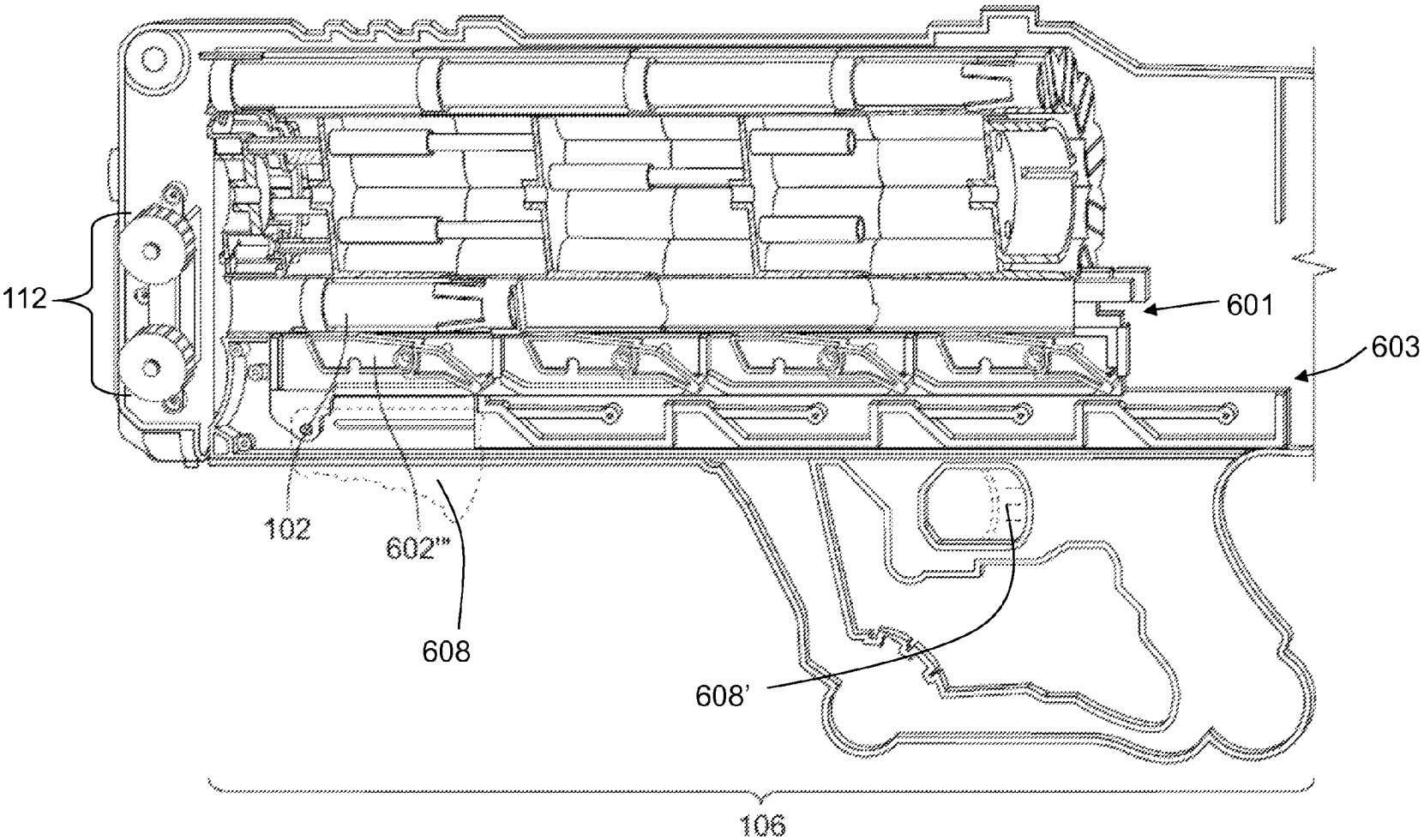

Referring to FIGS. 6G-6J, in some instances, when the process is restarted yet another different third engagement mechanism 602" can engage projectile advancer 604 which has advanced to third position. For example, referring to FIGS. 6G-6H, slide rack assembly 601 can be driven in a proximal/rearward direction causing third engagement mechanisms 602" to pivot/rotate in the first direction into engagement with projectile advancer 604. Referring to FIGS. 6H-6I, when pivoted third engagement mechanism 602" can engage projectile advancer 604 which has advanced to third position. With projectile advancer 604 engaged, slide rack assembly 601 can be driven in the distal/forward direction advancing projectile 102 to a fourth position thereby causing projectile 102' to interact with accelerator 112 such that projectile 102' can be launched from toy launcher 100. Referring to FIG. 6J, after advancing projectile 102 to the fourth position, third engagement mechanisms 602" can then pivot/rotate in the second direction thereby restarting the process such that at least one more projectile 102 can be launched from toy launcher 100.

Figure 6K:
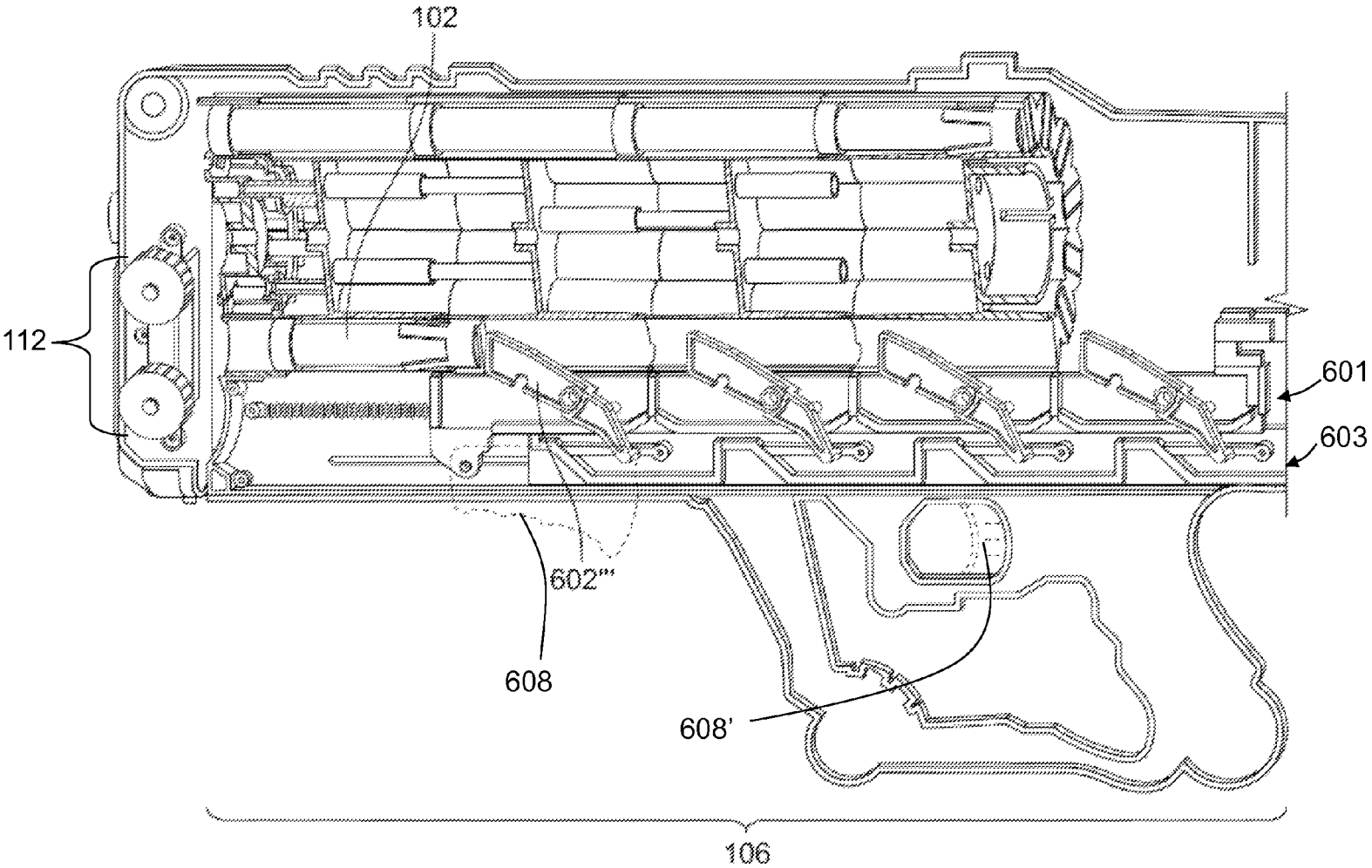
Figure 6L:
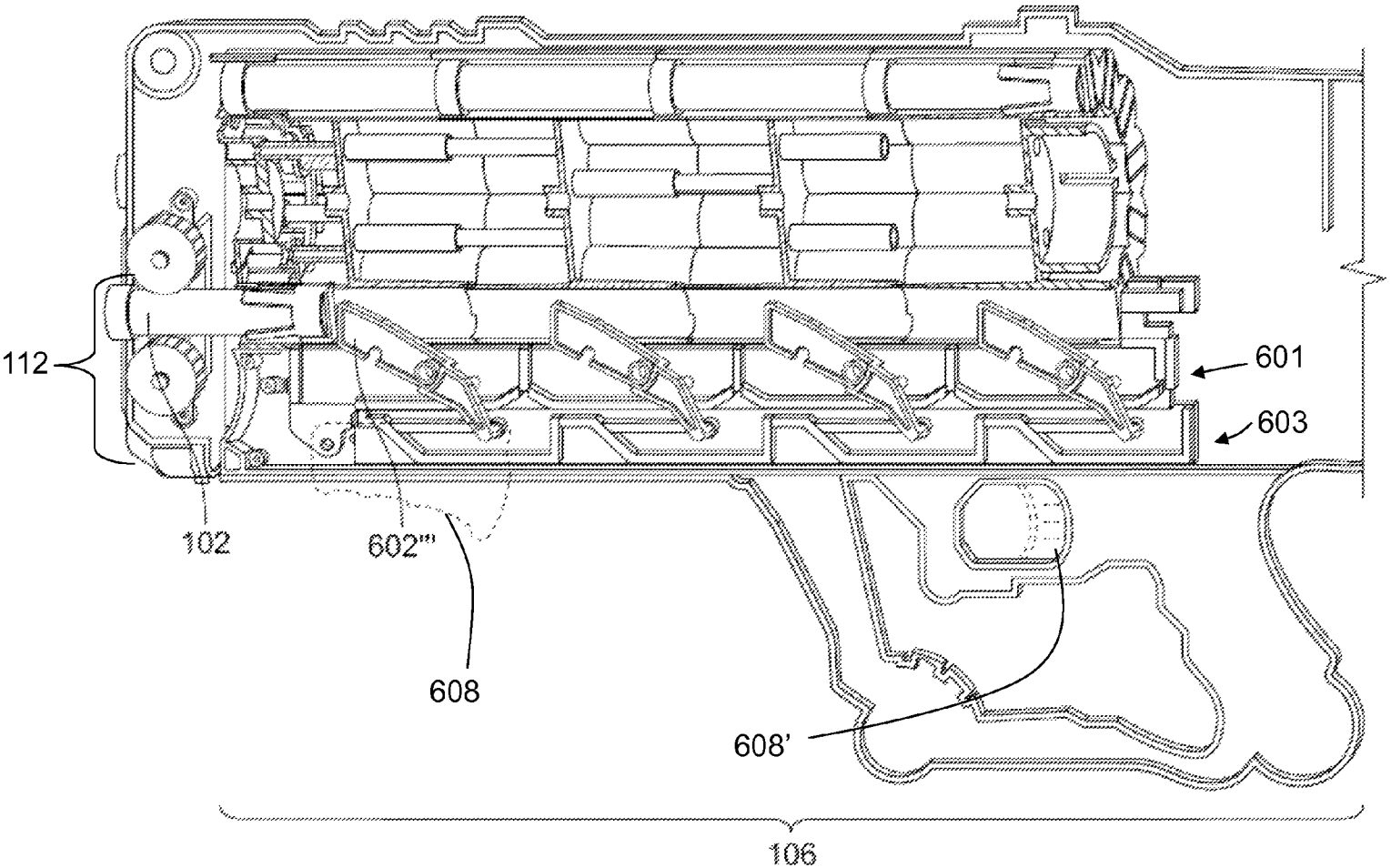

Referring to FIGS. 6J-6L, in some instances, when the process is restarted another different fourth engagement mechanism 602''' can engage projectile advancer 604 which has advanced to fourth position. For example, referring to FIGS. 6J-6K, slide rack assembly 601 can be driven in a proximal/rearward direction causing fourth engagement mechanisms 602''' to pivot/rotate in the first direction into engagement with projectile advancer 604. Referring to FIGS. 6K-6L, when pivoted the fourth engagement mechanism 602''' can engage projectile advancer 604. With projectile advancer 604 engaged, slide rack assembly 601 can be driven in the distal/forward direction advancing projectiles 102 forward thereby causing projectile 102 to interact with accelerator 112 such that projectile 102 can be launched from toy launcher 100. After advancing at least one projectile 102, fourth engagement mechanisms 602''' can then pivot/rotate in the second direction thereby restarting the process.

In exemplary embodiments, the distance which slide rack assembly 601 translates in a distal/forward and proximal/backward direction can be substantially equal to and/or slightly larger than the length of a single projectile 602. This can substantially reduce the amount of force required to move slide rack assembly 601 and/or reduce mechanical wear on toy 100.

It will be understood that engagement mechanism 602 may be able to engage projectile 102 directly rather than, for example, engaging projectile advancer 604. For ease, at times, engagement mechanism 602 is depicted as engaging projectile advancer 604. This is merely for ease and is in no way meant to be a limitation. Further, projectile advancer 604 can be designed to reduce stress concentration on projectile 102 when advanced. This may be done to reduce damage that may be caused to projectile 102 such as, but not limited to, tearing and/or ripping of projectile 102.

Further, to engage projectile 102 and/or projectile advancer 604, engagement mechanism 602 can substantially extend through interfacing region 306; projectile 102 and/or projectile advancer 604 can substantially extend through interfacing region 306; and/or projectile 102, projectile advancer 604, and/or engagement mechanism 602 can partially extend through interfacing region 306. For ease, engagement mechanism 602 is illustratively depicted, at times, as substantially extending through interfacing region 306. This is merely for ease and is in no way meant to be a limitation.

It will be understood that engagement mechanism 602 can be engaged by any number of mechanical element(s), electromechanical element(s), and/or any combination thereof that can cause engagement mechanism 602 to pivot/rotate. This rotating/pivoting can be driven by any element such as, but not limited to, a spring, a track assembly, a chord, a pusher, a puller, a motor, gearing assembly, piston, any combination or further separation thereof, and/or any element capable of causing engagement mechanism to rotate/pivot. For ease, at times, not all techniques and elements that can cause rotation/pivoting of engagement mechanism 602 are described. This is merely for ease and is in no way meant to be a limitation.

For example, engagement mechanism 602 can be rotatably/pivotably coupled to slide 601 and engagement mechanism 602 can be forcibly engaged by a torsion spring (not shown). Further, launcher 100 can include a slide interfacing region 603 constructed such that as slide 601 translates relative to a slide interfacing region 603 engagement mechanism can move between a confined position wherein engagement mechanism is forcibly confined in first position, a rotably/pivotable position wherein engagement mechanism 602 is capable of rotating/pivoting to a second position, and back to a confined position wherein engagement mechanism 602 is forced back to the first position. As another example, engagement mechanism 602 can be rotatably/pivotably coupled to slide 601 and engagement mechanism 602 can be engaged on a track (not shown) in, for example, interfacing region 603 such that as slide 601 translates engagement mechanism 602 rides the track causing it to rotate/pivot. As yet another example, engagement mechanism 602 can pivot/rotate when force is applied from a motor.

Slide rack assembly 601 can be driven by a user applying force on and/or interacting with user interface 608 and/or interface 608'. For example, slide rack assembly 601 can be manually operated by a user applying substantial enough force to drive user interface 608 in a forward and backward direction. As another example, slide rack assembly 601 can motorized such that it can shuttle in a forward and backward direction when a user applies force on and/or interacts with user interface 608' and/or user interface 608.

Referring to FIGS. 7A-7D, in exemplary embodiments, projectile launch assembly (not fully shown) can be constructed of at least one accelerator 112 that can receive projectile 102 exiting and/or about to exit receiving body 302 and accelerate projectile 102 out of toy launcher 100. It will be understood that accelerator 112 can be, but is not limited to, at least one rotating body, a pressurized gas, a pressurized liquid, a spring like device, and/or any reasonable device capable of accelerating projectile 102. For ease, accelerator 112 is, at times, depicted and/or described as at least one rotating body 702. This is merely for ease and is in no way meant to be a limitation.

Figure 7A:
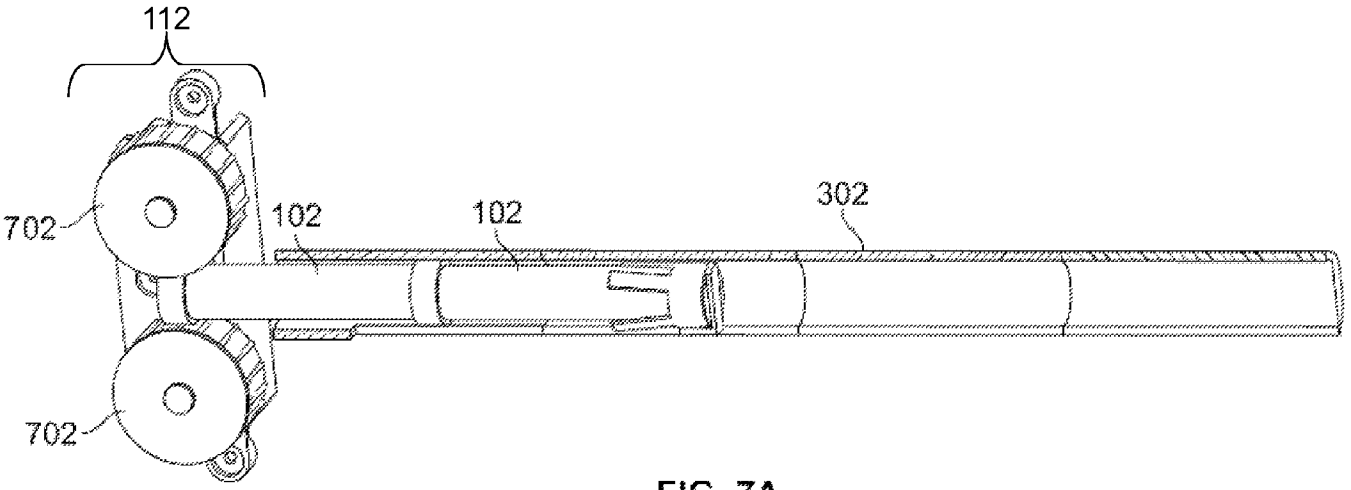
FIGS. 7A-7F illustratively depict projectiles accelerated by various projectile launch assemblies, in accordance with exemplary embodiments of the present invention.
Figure 7B:
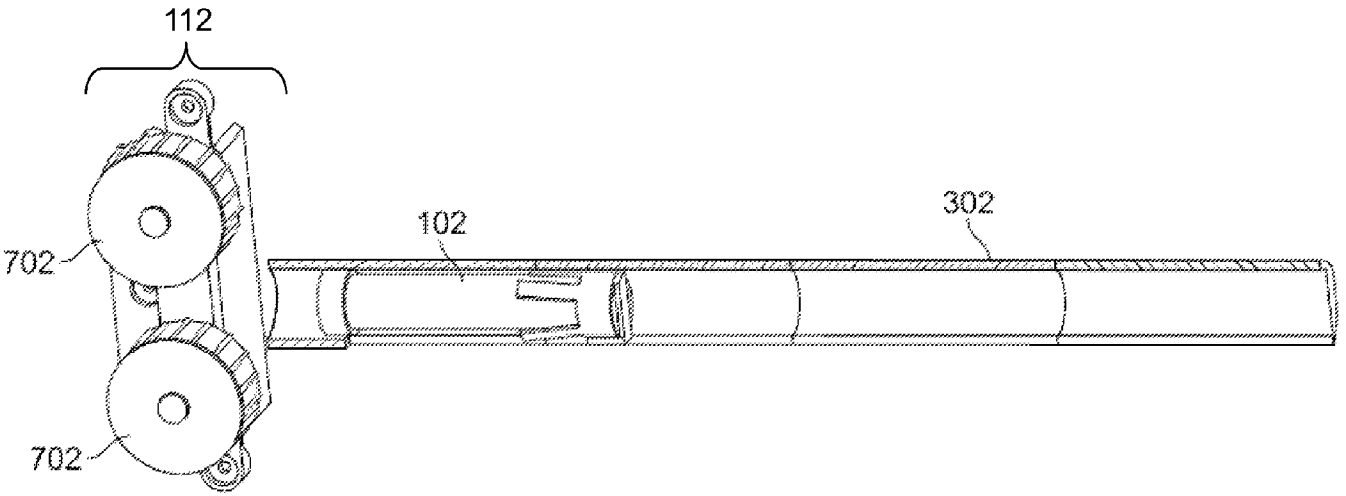
Figure 7C:
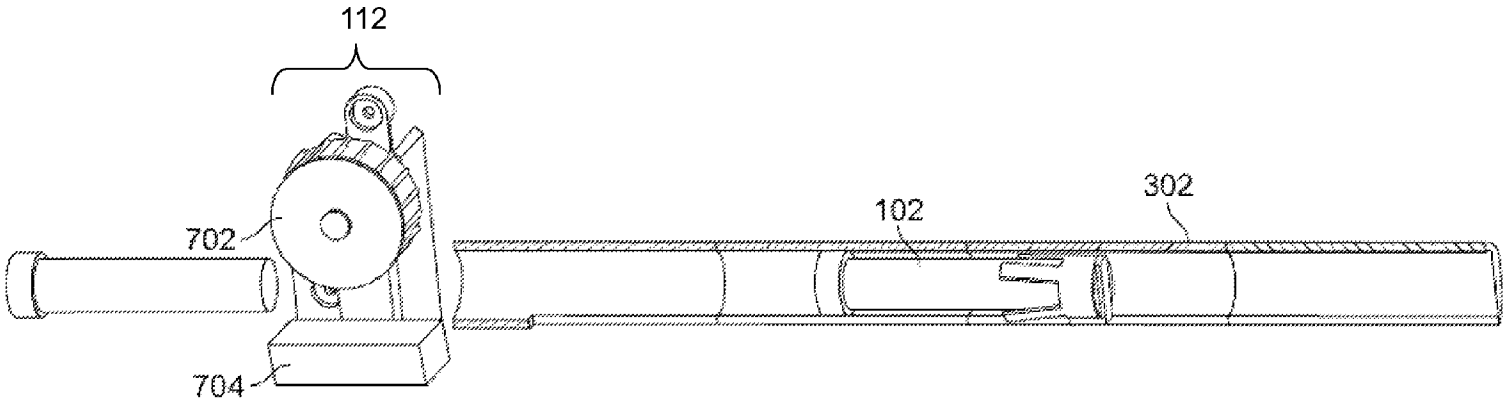

Referring to FIG. 7A-7B, accelerator 112 can include at least one rotating body such that when at least some of projectile 102 has exited the distal end of receiving body 302 at least some portion of projectile 102 can contact at least one rotating body 702 causing projectile 102 to accelerate out of the receiving body 302 and/or toy launcher 100.

Figure 7D:
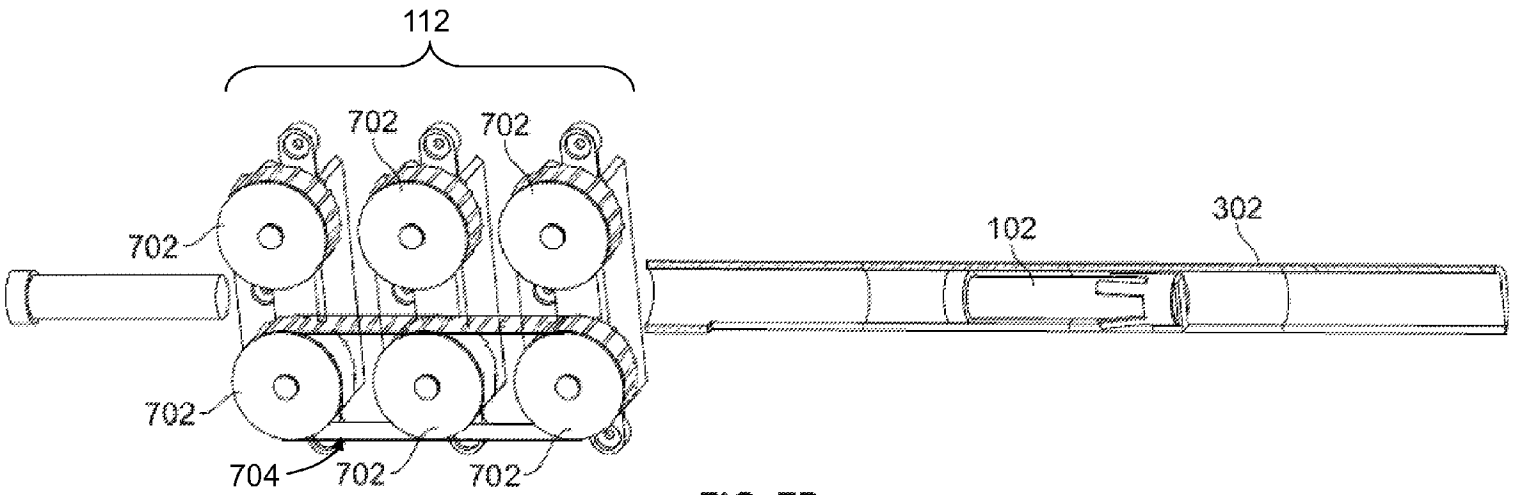

It will be understood that any reasonable number rotating bodies 702 can be used to accelerate projectile 102 from launcher 100. For example, referring to FIG. 7C, only one rotating body 702 may be required to accelerate projectile 102 from toy launcher 100. As another example, referring to FIG. 7D, more than two rotating bodies 702 can be used to accelerate projectile 102 from launcher 100. Further, in exemplary embodiments, accelerator 102 can include at least one tread/track 704. It will be understood that at least one tread/track 704 can be located on any number of rotating bodies. For ease, as shown in FIG. 7D tracker/tread 704 is illustratively depicted on one set of rotating bodies 702. This is merely for ease and is in no way meant to be a limitation.

Figure 7E:
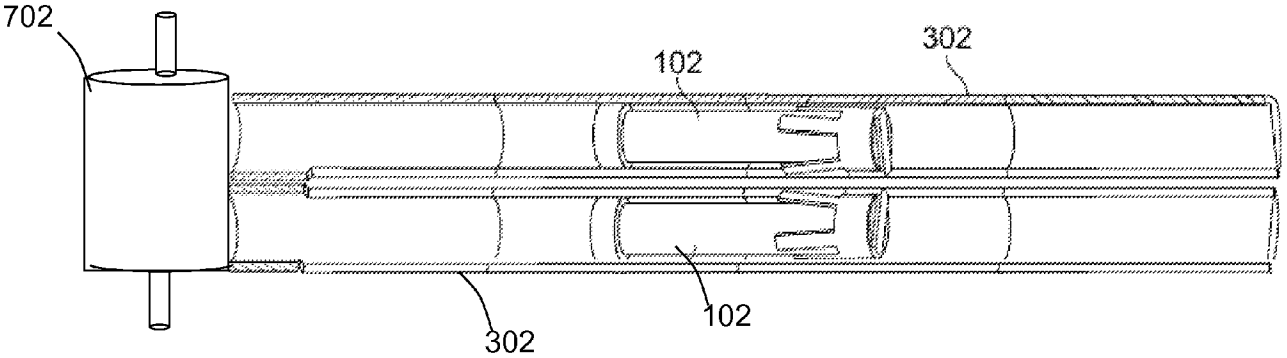
Figure 7F:
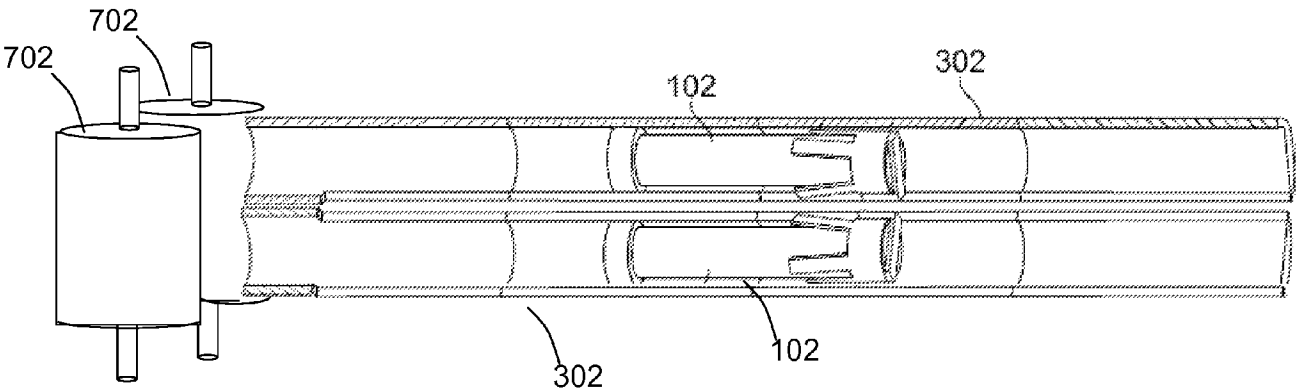

It will be understood that at least one rotating body 702 can located at any reasonable position such that projectile 102 can be launched from launcher 100. For example, referring to FIGS. 7A-7D, at least one rotating body 702 can be positioned such that the upper and/or lower regions of the projectile interface with at least one rotating body and/or referring to FIGS. 7E-7F, at least one rotating body can be positioned such that at least one sidewall of the projectile can interface with at least on rotating body. In some instances, the positioning of at least one rotating body may be selected such that more than one projectile may be launched at substantially the same time and/or in rapid succession.

In exemplary embodiments, rotating body 702 can be, but is not limited to, a flywheel, a tread/track driven about a flywheel, a roller, a roller at least partially covered by foam, and/or any other reasonable object capable of accelerating projectile 102 from launcher 100.

Further, rotating body 702 can be driven, for example, by a motor. In some instances this motor may be substantially loud and may act, for example, as a safety feature alerting a user and/or others that the toy launcher 100 is activated (e.g., rotating). Further, rotating body 702 can be activated by, for example, a user interface such as a switch, movement of toy 100, and/or a user contacting toy 100. In exemplary embodiments, rotating body 702 may be located substantially near the exit from toy launcher 100 to, for example, reduce frictional slowing of a launched projectile 102. Further, the speed at which rotating body 702 is set can be based on a desired launch speed for projectile 102 and may be controlled by the user and/or set by another. This may be done to reduce the risk of injury caused by a launched projectile.

In exemplary embodiments, the distance between a plurality of rotating bodies and/or at least one rotating body and another object can be sized based on physical dimensions of the projectile such as, but not limited to, the cross-sectional dimension of projectile 102 and/or mechanical properties of projectile 102 and/or rotating body 702 such as, but not limited to, the rigidity and/or compressibility of projectile 102 and/or rotating body 702.

Figure 8A:
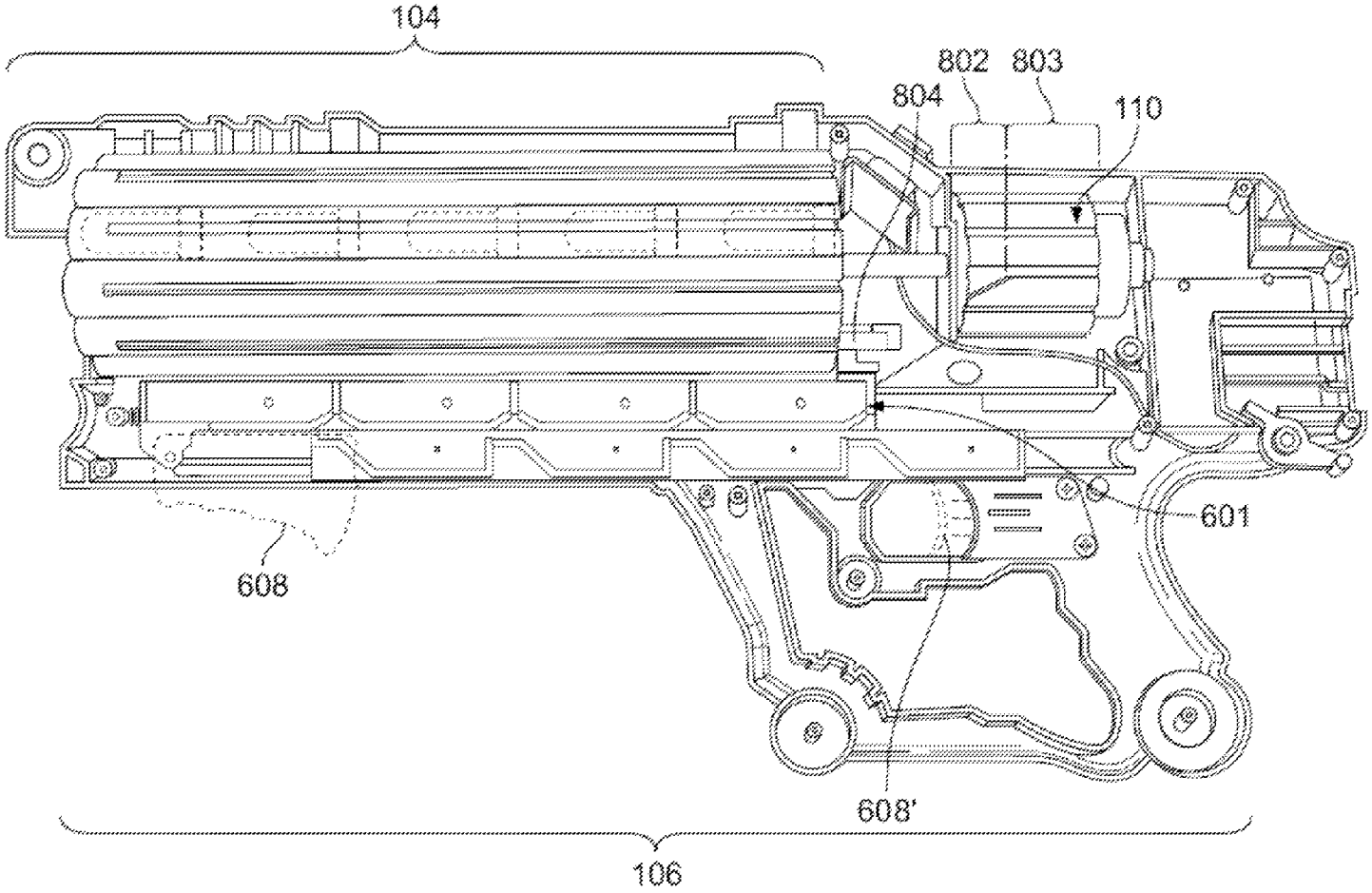
FIGS. 8A-8C illustratively depict rotation mechanisms for rotating a projectile feed assembly, in accordance with exemplary embodiments of the present invention.
Figure 8B:
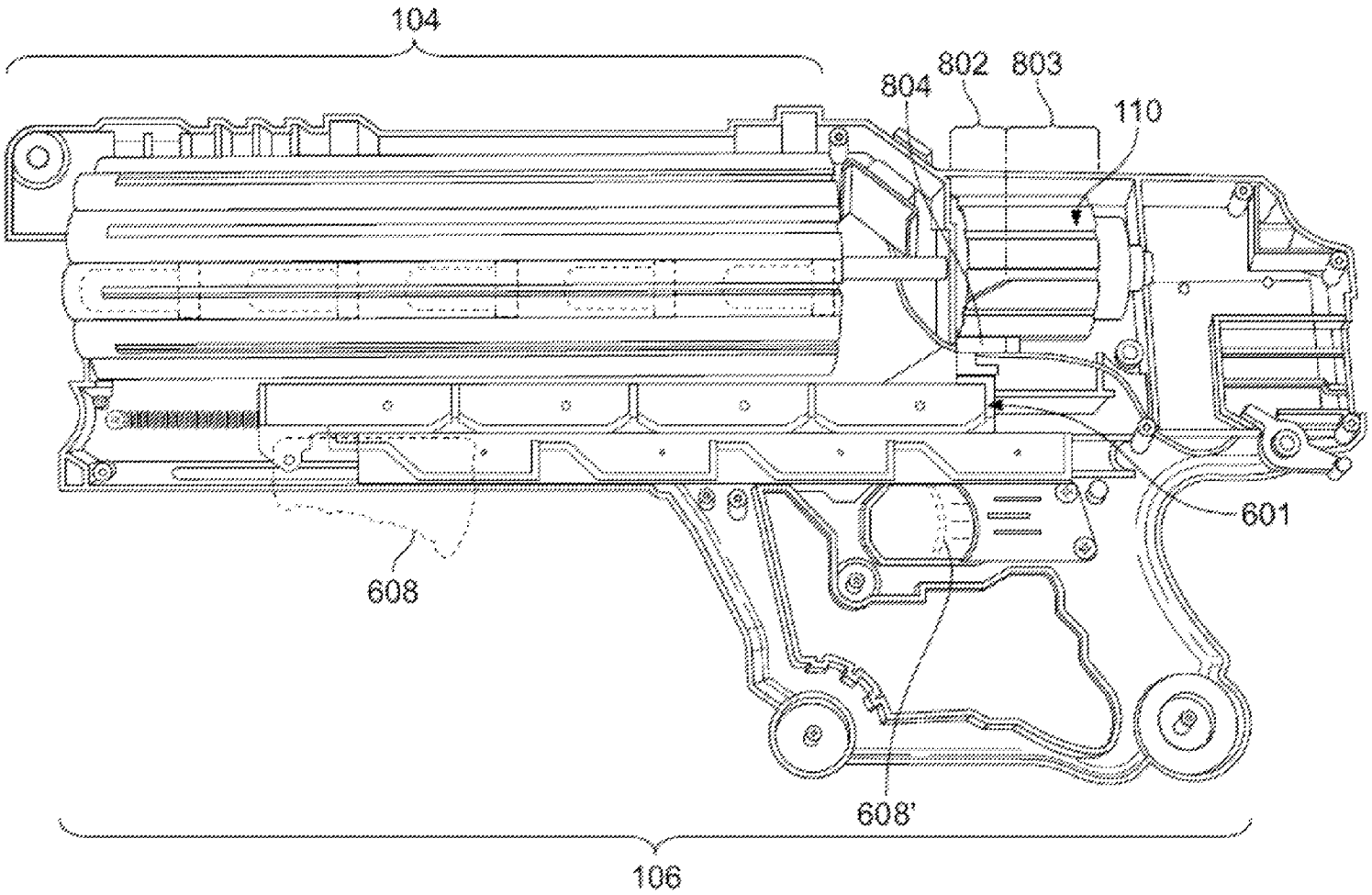
Figure 8C:
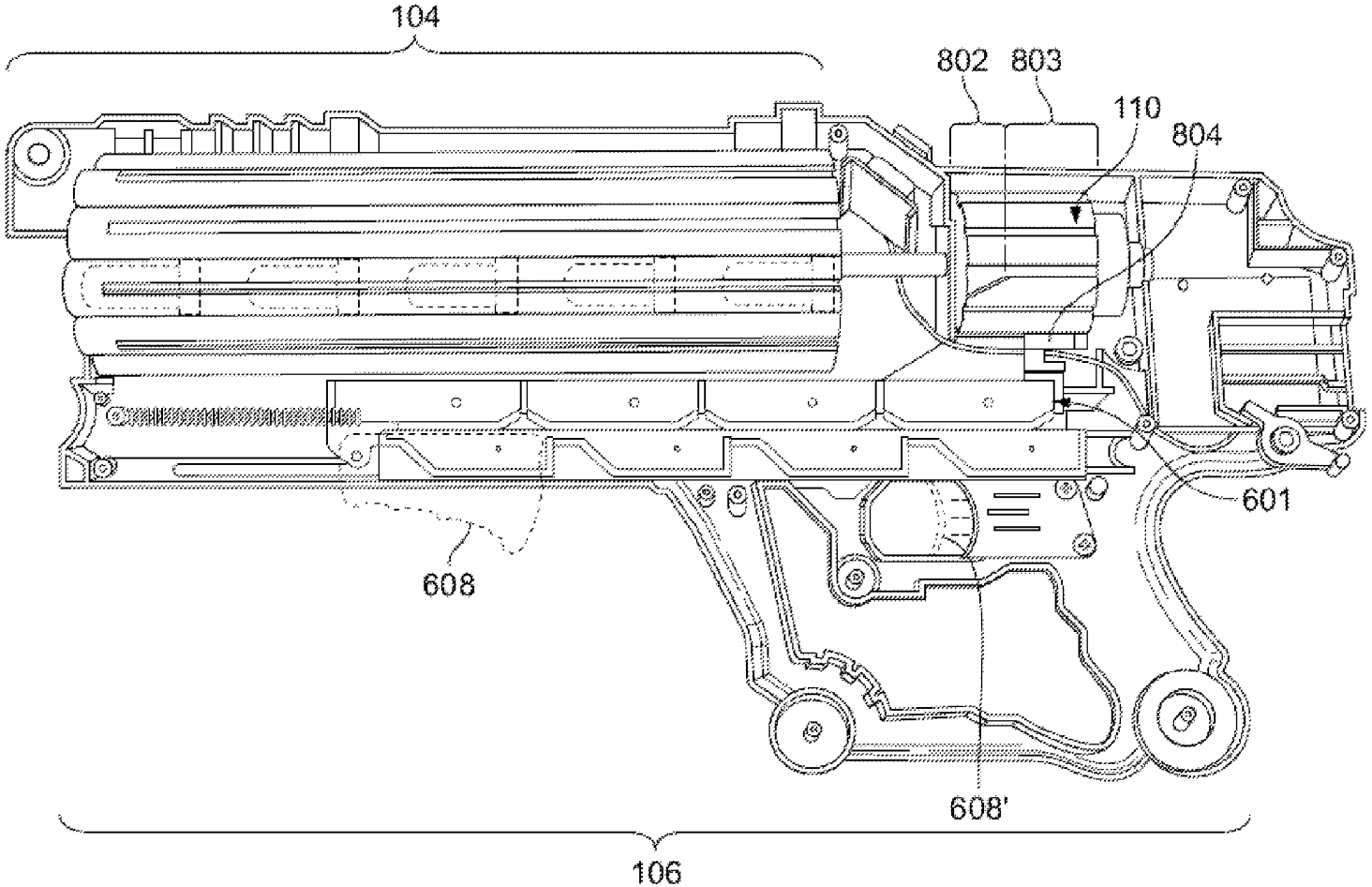

Referring to FIG. 8A-8C, projectile feed assembly 104 can be coupled to rotating mechanism 110 such that causing rotating mechanism 110 to rotate in turn causes projectile feed assembly 104 to rotate. Further, rotating mechanism 110 can include an interfacing rotating region 802 and an interfacing projectile advancing region 803 and user interfacing assembly 106 can include slide rack assembly 601 that can include an interfacer 804. Interfacer 804 and/or interfacing rotating region 802 can be designed such that the engagement of the interfacing rotating region 802 with interfacer 804 causes rotating mechanism 110 to rotate in turn causing projectile feed assembly 104 to rotate.

By way of example, referring to FIG. 8A, projectile feed assembly 104 housing projectiles 102 is illustratively depicted in a first position and, referring to FIG. 8B, interfacer 804 is illustratively depicted being received by interfacing rotating region 802 causing rotating mechanism 110 to turn thereby causing projectile feed assembly 104 to turn such that projectiles 102 are in a second position. Referring to FIG. 8C, after being received by interfacing rotating region 802, interfacer 804 can continue advancing into interfacing projectile advancing region 803 thereby allowing engagement mechanism 602 (not shown) to drive projectiles 102 from toy launcher 100, as described above.

The angle of rotation of rotation mechanism 110 and/or projectile feed assembly 104 can be based on the geometric configuration, sizing, and/or dimensions of receiving bodies 302 and/or projectile feed assembly 104. Further, the interaction of interfacing rotating region 802 and interfacer 804 can be designed to rotate rotation mechanism 110 and/or projectile feed assembly 104 a desired amount. For example, receiving interfacer 804 into interfacing rotating region 802 can cause projectile feed assembly 104 to rotate about 5 to 45 degrees.

Rotation mechanism 110 and/or projectile feed assembly 104 can be driven by a user applying force on and/or interacting with user interface 608 and/or user interface 608'. For example, slide rack assembly 601 can be manually operated by a user applying substantial enough force to drive user interface 608 in a forward and backward direction. As another example, slide rack assembly 601 can motorized such that it can translate in forward and backward direction when a user interacts with user interface 608' and/or interface 608.

It will be understood that rotation mechanism 110, projectile feed assembly 104 and/or slide rack assembly 601 can function substantially together, independent of one another, and/or by any other reasonable combination thereof For example, rotation mechanism 110 and/or projectile feed assembly 104 can rotate without interaction with slide rack assembly 601. By way of example, rotation mechanism 110 and/or projectile feed assembly 104 can be turned by a first user input and/or by a motor while slide rack assembly can move back and forth by a second user input and/or by a motor.

It will be understood that accelerator 112 can include compressed air, a mechanical air compressor, an electro-mechanical air compressor, a user power air compressor, a piston assembly, and/or any other reasonable device and/or technique capable of pressurizing air. A mechanical and/or electro-mechanical air compressor may be activated when a user interacts with user interface 608' and/or interface 608. For example, a user could pull back on interface 608 causing the launcher to load and press interface 608' to launch a projectile.

It will be understood that any elements and/or components of the toy described herein can be further combined and/or separated without deviating from the scope of the invention.

Now that exemplary embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A toy launcher for launching projectiles, comprising:

a projectile feed assembly including a plurality of receiving bodies having an opening extending a predetermined length of the projectile feed assembly;

a plurality of projectiles, the opening of each receiving body of the plurality of receiving bodies configured to receive at least one projectile of the plurality of projectiles so that the plurality of projectiles are housed sequentially along the length of the projectile feed assembly;

a projectile launching assembly including at least one accelerator; and a user interface assembly including at least one user interface capable of being activated by a user causing at least one portion of at least one of the projectile feed assembly and the projectile launching assembly to at least one of rotate and translate to cause at least one projectile housed in at least one receiving body of the plurality of receiving bodies to advance toward and interact with the at least one accelerator such that the at least one projectile is launched from the toy launcher.

2. The toy launcher for launching projectiles of claim 1, wherein the at least one accelerator further comprises at least one rotating body; and wherein at least one projectile of the plurality of projectiles is a three dimensional object having a length, width, and depth so that the at least one projectile can frictionally interact with the at least one rotating body.

3. The toy launcher for launching projectiles of claim 1, wherein the at least one accelerator further comprises at least one of compressed gas and a gas compressor.

4. The toy launcher for launching projectiles of claim 1, wherein the plurality of receiving bodies further comprises at least one projectile interfacing region that is a slot extending a length of at least one receiving body of the plurality of receiving bodies.

5. The toy launcher for launching projectiles of claim 4, wherein the user interface assembly further comprises:

a slide rack capable of translating in a direction substantially parallel to at least one receiving body of the plurality of receiving bodies;

at least one engagement mechanism coupled to the slide rack; and wherein, upon translation of the slide rack, the at least one engagement mechanism engages at least one projectile of the plurality of projectiles via the at least one projectile interfacing region to advance the at least one projectile toward the accelerator to cause the at least one projectile to interface with the accelerator and be propelled from the toy launcher.

6. The toy launcher for launching projectiles of claim 1, wherein the accelerator further comprises at least one rotating body.

7. The toy launcher for launching projectiles of claim 1, wherein the accelerator further comprises:

a first flywheel spaced a distance from a second flywheel, the distance being about a cross-sectional length of at least one projectile of the plurality of projectiles; and wherein the at least one projectile is accelerated out of the toy by interaction with the first and second flywheel.

8. The toy launcher for launching projectiles of claim 1, wherein the accelerator further comprises:

a first flywheel spaced a distance from a surface, the distance being about a cross-sectional length of at least one projectile of the plurality of projectiles; and wherein the at least one projectile is accelerated out of the toy by interaction with the first flywheel.

9. The toy launcher for launching projectiles of claim 1, wherein the accelerator is a tread driven about a flywheel.

10. The toy launcher for launching projectiles of claim 1, wherein the accelerator is a flywheel powered by a motor.

* * * * *